US006315402B1

(12) United States Patent
Kawase

(10) Patent No.: US 6,315,402 B1
(45) Date of Patent: Nov. 13, 2001

(54) INK JET RECORDING APPARATUS AND INK CONTAINER USED FOR SUCH APPARATUS

(75) Inventor: Junya Kawase, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/330,027

(22) Filed: Jun. 11, 1999

(30) Foreign Application Priority Data

| | | |
|---|---|---|
| Jun. 15, 1998 | (JP) | 10-167189 |
| Sep. 8, 1998 | (JP) | 10-253918 |
| May 27, 1999 | (JP) | 11-148193 |

(51) Int. Cl.[7] ..... B41J 1/175
(52) U.S. Cl. ..... 347/85
(58) Field of Search ..... 347/85, 86, 87, 347/89, 7

(56) References Cited

U.S. PATENT DOCUMENTS

| | | | | |
|---|---|---|---|---|
| 4,558,326 | * | 12/1985 | Kimura et al. | 347/35 |
| 4,689,642 | | 8/1987 | Sugitani | 347/87 |
| 4,973,993 | | 11/1990 | Allen | 347/7 |
| 5,126,767 | | 6/1992 | Asai | 347/86 |
| 5,159,348 | * | 10/1992 | Dietl et al. | 347/89 |
| 5,485,187 | * | 1/1996 | Okamura et al. | 347/85 |

FOREIGN PATENT DOCUMENTS

| | | | |
|---|---|---|---|
| 803362 | * | 10/1997 | (EP) . |
| 59-209878 | | 11/1984 | (JP) . |
| 2-63746 | | 3/1990 | (JP) . |
| 10-6521 | | 1/1998 | (JP) . |

OTHER PUBLICATIONS

J. Fox, "Ink Coantainer and Connection Valve for TIJ Printing System", Xerox Disclosure Journal, vol. 16, No. 1, Jan./Feb. 1991, pp. 11–13.

* cited by examiner

*Primary Examiner*—N. Le
*Assistant Examiner*—Michael Nghiem
(74) *Attorney, Agent, or Firm*—Fitzpatrick, Cella, Harper & Scinto

(57) ABSTRACT

An ink jet recording apparatus includes a sub-container arranged on an ink supply path between an ink container and an ink jet recording head. The sub-container is provided with an ink inlet port for receiving ink from the ink container, an ink outlet port for leading out ink to the recording head, a sub-ink bladder for forming a closed space with the exception of the ink inlet port and ink outlet port, and a case for protectively covering the bladder. A first open and close valve is provided for the ink inlet port, and a second open and close valve is provided for the ink outlet port. A pressure adjustment unit communicated with the communicating portion adjustably increases or decreases the pressure in the space between the sub-ink bladder and the case.

20 Claims, 19 Drawing Sheets

INK JET RECORDING APPARATUS AND INK CONTAINER USED FOR SUCH APPARATUS

BACKGROUND OF THE INVENTION

1. Field of the Invention

The present invention relates to an ink jet recording apparatus provided with an ink supply and recovery mechanism, which is utilized for an image forming apparatus, such as a printer, a facsimile equipment, a copying machine, or the like, and also, relates to an ink container used for such apparatus. More particularly, the invention relates to an ink jet recording apparatus provided with a full line type recording head that uses deaerated ink, and to an ink container used for such apparatus as well.

2. Related Background Art

The ink jet recording apparatus performs image recording, such as printing, by discharging ink from the recording head to allow it to be deposited to a recording medium. It is easier, therefore, to make the recording head compact and record highly precise images at high speeds and lower running costs. Being non-impact type, the apparatus makes a lesser amount of noises, and also, among some other advantages, it makes color image recording easier by use of many colors of ink. Of these apparatuses, the ink jet recording apparatus of full line type, which uses the line type recording head having many numbers of discharge ports arranged in the width direction of a recording medium, makes recording possible at a speed higher still.

As the method for supplying ink to a recording head of the kind, it is often practiced to adopt a method in which a container of a large capacity is installed integrally with the main body of a recording apparatus together with the ink flow paths, such as tubes, formed between the container and the head cartridge, as well as the mechanism provided for the ink flow paths to carry ink to the head cartridge in consideration of the event that recording may be performed on a large-sized recording medium or liquid should be replenished when the container is installed on the apparatus whose recording volume is great, and then, ink is replenished by means of the mechanism thus provided.

The present inventor has disclosed the structure in the specification of Japanese Patent Application Laid-Open No. 10-6521 wherein a sub-container is arranged to supply liquid to the downstream side by introducing the air while provisionally retaining liquid in the intermediate portion of the liquid supply route, and also, disclosed in the same specification the replenishing method wherein the sub-container is arranged to be a closed space having the reduced pressure in it, then, liquid is replenished in the sub-container while reducing the inner pressure thereof. In accordance with this method, negative pressure generating means can be arranged for the route different from the liquid supply route in order to reduce the inner pressure of the sub-container, hence making it possible to simplify the structure of the liquid supply route. This is an excellent invention that provides the liquid supply system capable of supplying liquid stably without any creation of dust particles when liquid passes the carrying means as compared with the case where the pump or some other liquid carrying means is arranged in the liquid supply route.

In accordance with the invention disclosed in the specification described above, the flow path structure is made simpler for ink supply, and the sub-container thus disclosed in the specification thereof is open to the air outside when liquid is supplied to the recording head. In recent years, however, there has been more demanded on the higher speed recording of more precise images than those conventionally practiced. As a result, the deaerated ink may be used sometimes as one of the methods to obtain the stabilized ink discharges for printing. With the use of the deaerated ink, it becomes possible to prevent bubbles from created in ink unexpectedly. However, since the sub-container is usually open to the air outside, there is a problem that the degree of deaerated condition of ink is lowered as the time elapses.

Also, for the liquid supply from the sub-container to the recording head, the water head difference is utilized or a small ink container is arranged additionally for the recording head unit to provide a capillary force generating member as the one to create the negative force in the interior of such smaller ink container. However, since the sub-container is open to the air outside, there is a need in either case for the provision of suction process by use of a recovery pump to supply ink to each of the nozzles of the recording head of full line type. Then, there is a fear that a considerable amount of ink is exhausted wastefully.

On the other hand, from the viewpoint of using a larger ink container which should be installed on a recording apparatus, it is conventionally practiced to use the ink container provided with an ink bladder laminated with aluminum foil film in consideration of the gas permeability and resistant to shocks. In recent years, however, with the environmental problems which should be dealt with carefully, it has become necessary to provide an ink container which is structured to be easily incinerated for disposition or recycled, while satisfying the condition of the gas permeability and resistance to shocks.

SUMMARY OF THE INVENTION

The present invention is designed in consideration of the technical problems that have been discussed above. It is a first object of the invention to provide an ink jet recording apparatus built as simply as possible, which is capable of using ink in the container effectively for the stabilized output of images in high quality.

It is a second object of the invention to provide an ink container structured to be easily incinerated for disposition or recycled, while satisfying the condition of the gas permeability and resistance to shocks in combination with the first object of the invention or individually.

The specific objectives of the present invention are understandable from the structures given below.

In order to achieve the first object described above, the ink jet recording apparatus of the present invention comprises an ink jet recording head for discharging ink to enable ink to adhere to a recording medium for the formation of images; an ink container provided with an ink bladder to store ink to be supplied to the recording head; an ink supply path for supplying ink from the ink container to the recording head; a sub-container arranged on the ink supply path to retain ink from the ink container provisionally and supply the ink to the recording head. For this ink jet recording apparatus, the sub-container is provided with an ink inlet port for receiving ink form the ink container, and an ink outlet port for leading out ink to the recording head; a sub-ink bladder for forming a closed space with the exception of the ink inlet port and ink outlet port; and a case for covering the bladder, having at the same time a communicating portion with the outside, to protect the bladder in the closed space with the exception of the communicating portion, and provided further with a first open and close valve provided for the ink inlet port; a second open and close valve provided for the ink outlet port; and pressure adjustment means communicated with the communicating portion to be able to adjust the pressure in the space between the sub-ink bladder and the case.

In accordance with this ink jet recording apparatus, the deaerated ink which is used is not exposed to the air outside in the ink supply path from the ink bladder to the recording head. As a result, there is no fear that degree of deaeration of ink is not lowered. In addition, the pressurizing and pressure reducing operations are performed by use of pressure adjustment means, which makes it possible to implement the ink replenishing from the main container to the sub-container, and the sub-container to the recording head, as well as the recovery operation, without the provision of a pump or the like for the ink supply path. At the same time, as to the ink replenishing from the sub-container to the recording head in particular, it is executed by the pressurizing operation. Therefore, it becomes possible to provide the ink jet recording apparatus capable of using ink in the ink container effectively for the stabilized output of images in higher quality.

Also, the ink container of the present invention, whereby to achieve the second object thereof, is mountable on the ink jet recording apparatus described above, which comprises an ink bladder containing ink, and an ink supply port to lead out ink in the ink bladder to the outside. Then, this ink bladder is formed by flexible resin material.

For the ink jet recording apparatus described above, it is unnecessary to consider the water head difference and the balance of the negative pressure between this ink container and the recording head. As a result, in order to solve the second subject as discussed above, it is possible to use effectively even an ink container having greater pressure changes along with the led-out of ink, although it is flexible, or having a higher negative pressure exerted on the ink supply port. For the ink container described above, resin is used for its ink bladder as its material, hence dealing with the environmental problems, and at the same time, making it possible to form the ink container firmly (or a thick bladder) which has a smaller amount of deformation following ink to be led out with the utilization of the effect produced by the aforesaid recording apparatus. Thus, it is made possible to provide the ink container which can satisfy the condition of gas permeability, as well as the resistance to shocks.

In order to achieve the second object of the present invention, the ink container of another embodiment comprises an ink bladder containing ink, and an ink supply port to lead out ink in the ink bladder to the outside. Then, the ink bladder is formed by flexible resin material, and at the same time, the inner pressure at the ink supply port of the ink bladder is set at −200 mmAq. or less with respect to the air outside before the ink container beings to be used.

In accordance with this ink container, the ink bladder is formed by resin material to make it easier to incinerate the ink container for disposition or to be recycled, and the same time, it becomes possible to provide the ink container for which there is almost no possibility that the bladder is broken due to shocks or the repeated abrupt changes of environment during the deliver or the ink leakage due to damages that may be given to the seal of the ink supply port due to shocks during delivery, because the negative pressure is made higher in advance at the initiation, and also, the robustness of the material itself that forms the bladder is higher.

DETAILED DESCRIPTION OF THE PREFERRED EMBODIMENTS

Now, with reference to the accompanying drawings, the embodiments will be described in accordance with the present invention.

At first, using FIG. 1 the description will be made of the outline of the ink jet recording apparatus as a whole in accordance with the present invention.

Figure 1:
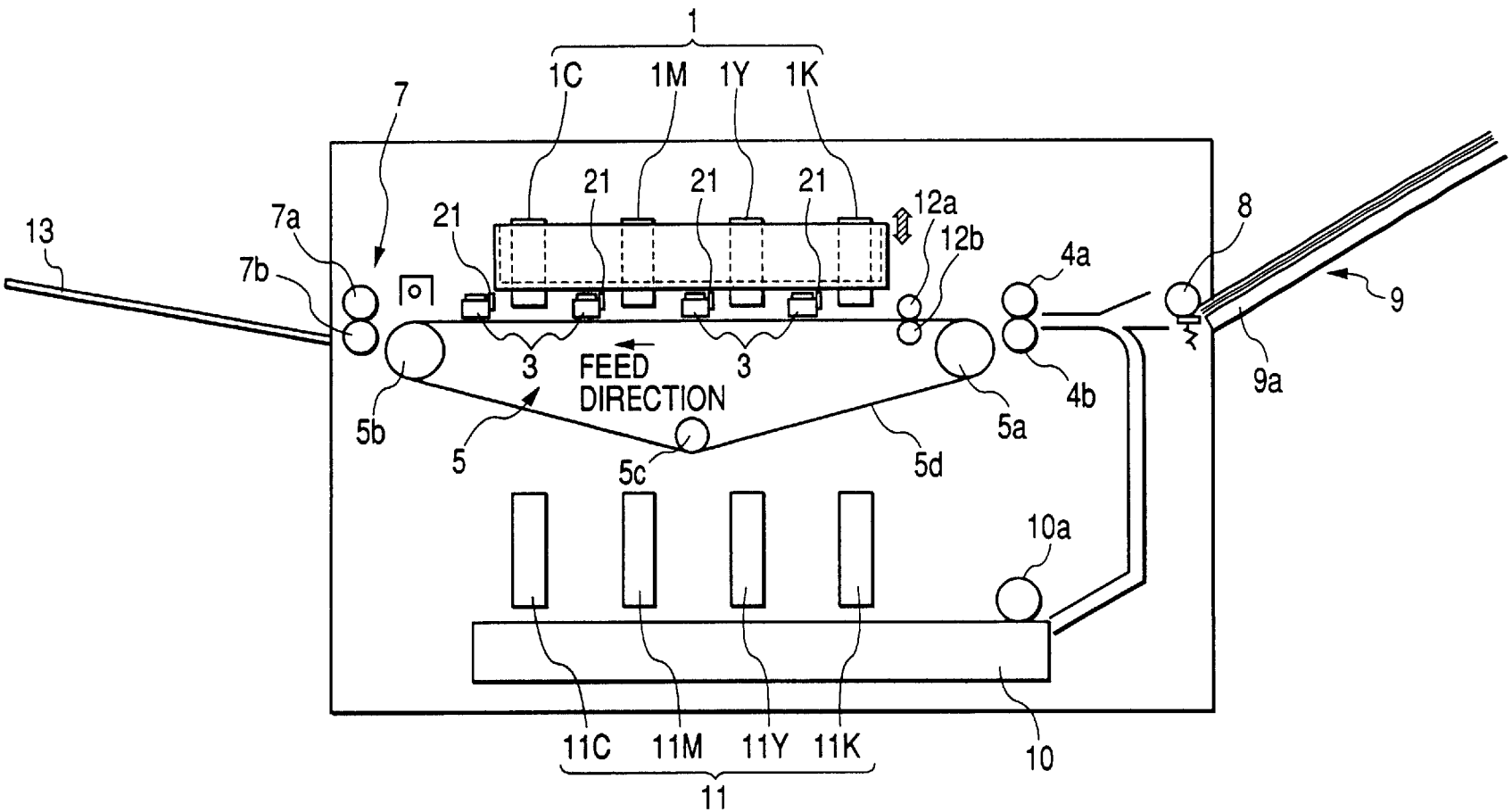
FIG. 1 is a front view which schematically shows one example of the entire structure of an ink jet recording apparatus in accordance with the present invention.

As shown in FIG. 1, the ink jet recording apparatus comprises a color recording head 1; a color ink container 11;

a sheet supply cassette 10; a manual sheet feeding mechanism 9; recording medium carrying means 5; and sheet exhausting mechanism 7.

A recording sheet which is a recording medium is supplied by means of cassette sheet feeding or manual sheet feeding. When the cassette sheet feeding is adopted, each of the recording sheet in the sheet supply cassette 10 is guided by means of feed roller 10*a* to recording medium carrying means 5. When the manual sheet feeding is adopted, a recording sheet on the sheet feeding tray 9*a* is guided a feed roller 8 to the recording medium carrying means 5. Although not described in detail, there are the method (Duplo method) that separates recording sheet by one by using the feed rollers 8 and 10*a* in cooperation with the separation pad, the nail separation method, the retarding method, among some other feeding methods.

The leading end of a recording sheet, which is guided to the recording medium carrying means 5 by use of the cassette sheet feeding or the manual sheet, abuts upon a pair of resist rollers 4*a* and 4*b* which are at rest. Further, when the feed rollers 8 and 10 are caused to rotate slightly, the recording sheet is slackened between the resist rollers 4*a* and 4*b* and the feed rollers 8 and 10 to make it possible to correct the slanted feed of the recording sheet. Then, when the photosensor (not shown) detects that the recording sheet has abutted upon the contacting portion of the resist rollers 4*a* and 4*b*, the resist rollers 4*a* and 4*b* are allowed to rotate. The recording sheet thus fed by means of the resist rollers 4*a* and 4*b* is pinched by a carrier belt 5*d* and a pair of pinch rollers 12*a* and 12*b*. Although not shown, a high voltage is applied to the lower roller 12*b* of the pinch rollers, and the upper roller 12*a* is grounded. Therefore, the recording sheet that has passed the pinch rollers 12*a* and 12*b* is carried by the carrier belt 5*d*, while being adsorbed thereon electrostatically. The carrier belt 5*d* is tensioned around the driving roller 5*b*, the driven roller 5*a*, and the pressure roller 5*c*, and caused to rotate by means of the driving roller 5*b* which is driven by a pulse motor serving as the driving source (not shown). Therefore, the recording sheet which is electrostatically adsorbed on the carrier belt 5*d* is carried to the print initiating position directly below the recording head 1 along with the rotation of the carrier belt 5*d*. In this respect, the pressure roller 5*c* is rotatively mounted on the leading end of the swingable arm (not shown) which gives tension to the carrier belt 5*d* with the biasing force exerted on it by means of a spring.

The recording head 1 is of the full line type where many numbers of the recording elements are arranged over the entire width of the recording area of a recording sheet, and there are arranged from the upstream side the four heads, 1K (black), 1Y (yellow), 1M (magenta) and 1C (cyan), are respectively arranged at specific intervals in that order, and then, installed on the head holder 2. Also, four caps 3 are arranged to prevent the nozzles from being dried when the recording head is not in print operation, and also, to receive the exhausted ink from the nozzles when the recovery operation is performed. The caps 3 are supported by a cap supporting member (not shown), and positioned adjacent to each of the four recording heads 1 when the printing is in operation. At the time of capping, the recording heads 1 shift upward together with the head holder 2. Then, each of the caps 3 shifts to the position directly below each of the recording heads 1. With the sliding of caps 3, the elastic members 21, such as urethane rubber, fixed to the end portions of the caps 3, respectively, wipe off ink residing on each face portion of the recording heads 1. Then, when the recording heads 1 are lowered together with the head holder 2, while the caps 3 are positioned directly below the recording heads 1, each of the head face portions is placed on each of the caps 3 to effectuate the capping of the heads 1.

For the present embodiment, each of the recording heads 1 is provided with heaters to give head to ink. The film boiling of ink is created by this heating, and ink is discharge onto the recording sheet for the image formation by means of the pressure changes that follow the development or contraction of bubbles brought about by the film boiling thus created.

Then, the resist roller 4*a* and 4*b* are allowed to begin rotation, which functions as a trigger to set the timing, so that the recording heads 1K, 1Y, 1M, and 1C receive driving signals appropriately from driving means (not shown), thus forming desired images by discharging ink onto the specific positions on the recording sheet.

As described above, the recording sheet is adsorbed by the electrostatic adsorption to the upper face of the carrier belt 5*d*, and carried by the carrier belt 5*d*, while printing is being performed on the recording sheet by means of the recording heads 1.

The recording sheet having the images thus formed on it is carried to the sheet exhaust mechanism 7. The exhaust roller 7*b* of the sheet exhaust mechanism 7 is driven to rotate by the driving source (not shown), while the spur 7*a* is in contact with the exhaust roller 7*b* under pressure. The recording sheet after the image formation is pinched by the exhaust roller 7*b* and the spur 7*a* to be exhausted onto the sheet exhaust tray 13 for storage. The spur 7*b* is configured to arrange many numbers of small extrusions having acute tips (not shown) on its outer circumference so as not to allow ink of the printed images to be transferred to stain the spur even if it is in contact with the printed surface after recording.

Now, the detailed description will be made of the ink supply and recovery mechanism, and the ink container, which are the features of the present invention, in accordance with each of the embodiments given below. Here, in each of the following embodiments, the structure is arranged so that the ink supply paths in the recording head are divided in two directions on the way, and that ink is supplied from both ends of the head liquid chamber. However, the invention is not necessarily limited to such structure. It may be possible to apply the invention to any other structures of the ink supply paths.

First Embodiment

Figure 2:
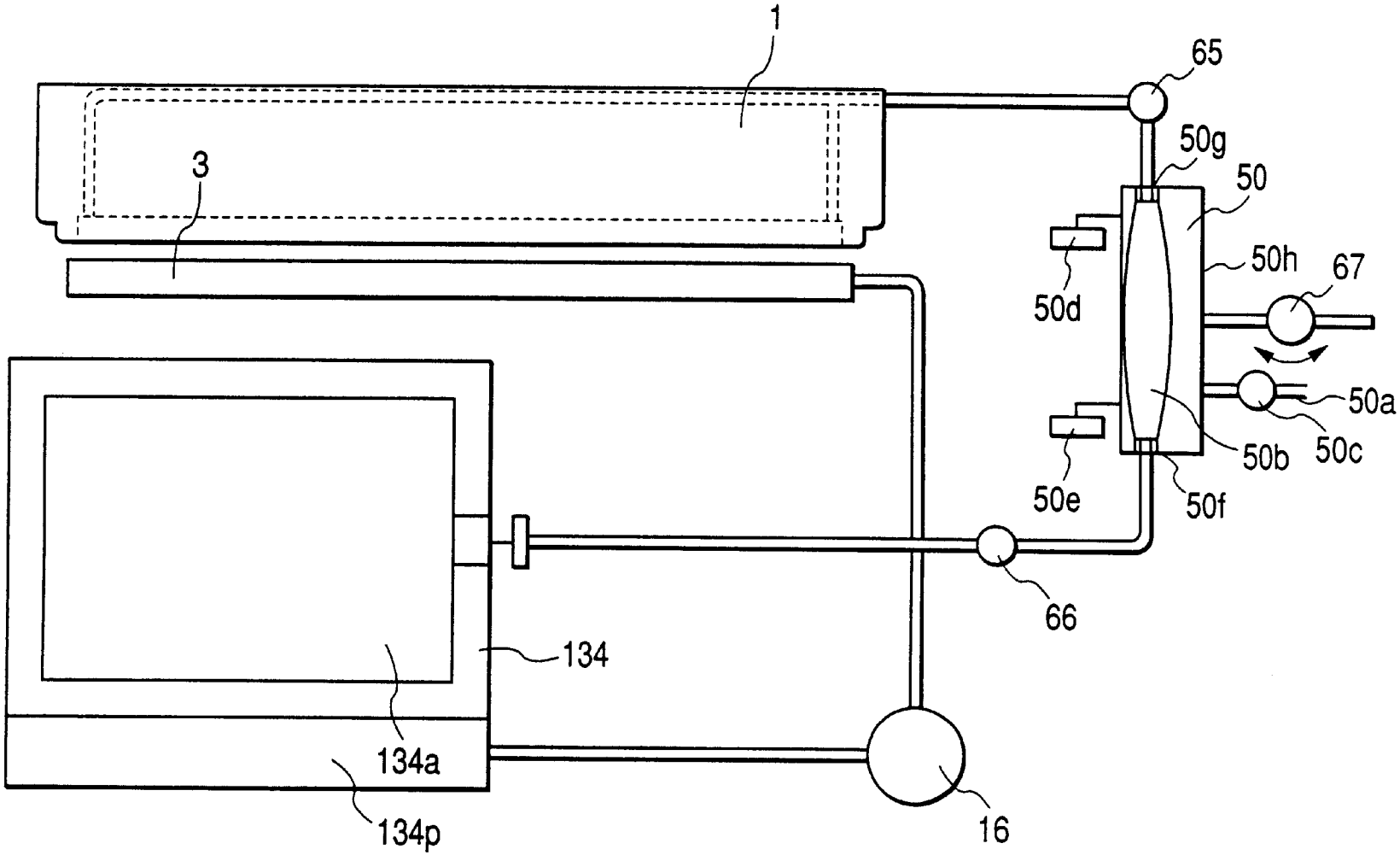
FIG. 2 is a view which illustrates the ink supply paths of the ink jet recording apparatus in accordance with a first embodiment of the present invention.

FIG. 2 is a view which illustrates the ink supply path of the ink jet recording apparatus in accordance with a first embodiment of the present invention. For the present embodiment, the ink supply and recovery device comprises the recording head 1, the sub-ink container 50 provided with the sub-ink bladder 50*b*, and the ink container 134.

Figure 5A:
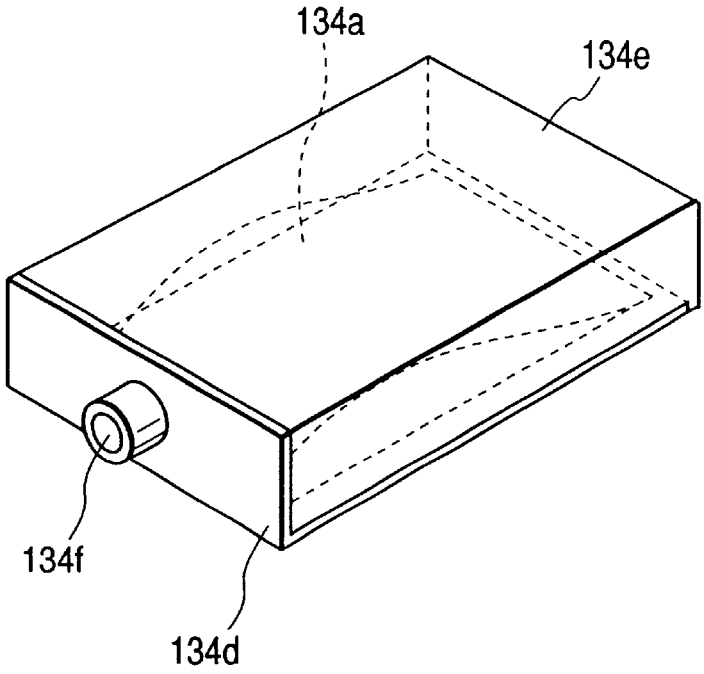
FIGS. 5A and 5B are perspective views which illustrate the ink container which is mountable on the ink jet recording apparatus in accordance with the first embodiment of the present invention.

As shown in FIG. 5A, the ink container 134 is such that the ink bladder 134*a* containing ink in it is covered by the cover containers 134*d* and 134*e*, and the atmospheric communication port (not shown) is arranged for it. Then, for the ink supply port 134*f* of the ink container 134 installed on the insertion port of the recording apparatus main body, the ink supply needle 48 is pierced to make it possible to supply ink from the ink bladder 134*a* to the ink supply path in the recording apparatus main body. The ink supply port 134*f* of the ink container 134 is structured to be connected when the ink supply needle 48 is pierced. Therefore, this port is provided with the elastic member formed by rubber or the like in order to prevent ink leakage when the ink supply needle is pieced or pulled off from it.

Here, a reference numeral 134*p* designates the unwanted ink absorbent that absorbs ink exhausted in the recovery process which will be described later. As the unwanted ink absorbent, the usual non-woven textile, urethane form, or the like can be used without any problem if only it has an excellent hygroscopic property. For the present embodiment, however, the unwanted ink absorbent comprises the ink absorbing layer which is formed by the cotton pulp textile that contains polymeric absorbent, and the non-woven cloth that covers this layer. Then, the non-woven cloth is heat sealed to form the structure that the ink absorbing layer is provided in the non-woven cloth bladder. As the material of the non-woven cloth, nylon, polyester, polypropylene, or some other synthetic fibers can be used. For the present embodiment, the polymeric absorbent in the ink absorbing layer is swelled if the unwanted ink enters the unwanted ink absorbent, and this layer changes to the gelled substance whose volume is increased corresponding to the volume of absorbed moisture. Then, ink in the ink bladder is consumed to shrivel the ink bladder. In other words, for the ink container of the present embodiment, the ink bladder is shriveled along with the consumption of ink, but the unwanted ink absorbent is swelled instead. Thus, there is an advantage that the unwanted ink absorbent can be utilized effectively to the extent that it has been swelled.

On the ink supply path from the ink container 134 to the recording head 1, the sub-container 50 is arranged to retain ink form the main container provisionally, and then, to supply it to the recording head. Here, the sub-container 50 is provided with the ink inlet port 50*f* to receive ink from the ink container 134 and the ink outlet port 50*g* through which ink is supplied to the recording head 1. Then, there are provided the sub-ink bladder 50*b* which forms a closed space with the exception of the ink inlet port 50*f* and the ink outlet port 50*g*, and the case 50*h* which covers the sub-ink bladder 50*b*, and which is provided with the communicating unit with the outside, and then, protects the bladder in this closed space with the exception of the communicating unit. For this communicating unit, a suction and compression pump 67 is provided as means for adjusting pressure capable of adjusting pressure in the space between the sub-ink bladder 50*b* and the case 50*h*. The suction and compression pump 67 sends the air to the circumference of the sub-ink bladder 50*b* in the sub-ink container 50 or sends out the air on the circumference of the sub-ink bladder 50*b* in the sub-container 50 to the outside of the sub-container 50. This pump is provided with the compressing and sucking functions. Here, a tube pump, a cylinder pump, or the like is most suitable, which should be provided the sucking and compressing functions executable by the regular or reverse rotation of the driving source (motor) of the suction and compression pump 67. In accordance with the present embodiment, a tube pump is used for the suction and compression pump 67. Then, the structure is arranged so that the inner space of the case is pressurized by sending the air to the interior of the case at the time of regular rotation, and that the inner pressure is reduced by exhausting the air from the interior of the case at the time of reverse rotation.

In accordance with the present embodiment, there are provided besides them the atmospheric communication port 50*a* which enables the air outside and the interior of the case to be communicated; and the open and close valve 50*c* for the atmospheric communication port to open or close this port. Then, it is made possible to control the communication between the space in the interior of the case and the air outside irrespective of the relationship between the tube pump and the tube. Here, a reference numeral 50*d* designates a pressure sensor to detect the pressure in the space between the sub-container bladder and the case, which is used for the control of the ink supply and the recovery operation to be described later. As such sensor, it is desirable to adopt the one, such as a semiconductor pressure sensor, which can detect pressure linearly. Here, also, a reference numeral 50*e* designates the sub-container remainders sensor to detect the amount of ink (or the absence or presence of ink) in the sub-container. In accordance with the present embodiment, the structure is arranged to detect the thickness of the sub-container bladder by means of the photosensor and the sensor flag.

Now, a first open and close valve 66 is installed between the ink inlet port 50*f* and the ink container 134 on the ink supply path, and a second open and close valve 65 is installed on the ink supply path between the ink outlet port 50*g* of the subs-container and the recording 1. For the open and closed valves 65, and 66, it is conceivable to adopt the solenoid open and close valve for each of them, which is provided with the valve function together with the sealing function arranged for the plunger of the solenoid. In accordance with the present embodiment, the structure is arranged so that the open and close valve 65 is released when the solenoid power source is turned on, and it is closed, when the power source is turned off, and that the open and close valve 66 is closed when the solenoid power source is turned on, and released when it is turned off.

Now, in conjunction with the flowcharts shown in FIGS. 3A and 3B, and FIG. 4, the description will be made of the supply operation of various kinds of liquids and the recovery operation of the ink jet recording apparatus in accordance with the first embodiment of the present invention.

(1) The Usual Liquid Supply Operation

For the usual liquid supply, such as for printing operation, the first open and close valve 66 is closed, while -the second open and close valve 65 and the open and close valve 50*c* for the atmospheric communication port are released, respectively. Then, without operating the suction and compression pump, the recording is performed by the utilization of water head difference between the sub-container and the recording head. In accordance with the present embodiment, the capacity (50 cc to 100 cc approximately) of the sub-container is smaller than that of the main container (400 cc to 600 cc approximately). Therefore, it is possible to arrange the sub-container by the utilization of the dead space of the carrier system (recording medium carrying means 5) of the recording medium within the apparatus, and to implement making the ink jet apparatus smaller as compared with the case where ink is supplied to the recording head directly from the main container by the utilization of the water head difference.

(2) The Deaerating Operation of the Sub-Container

Figure 3A:
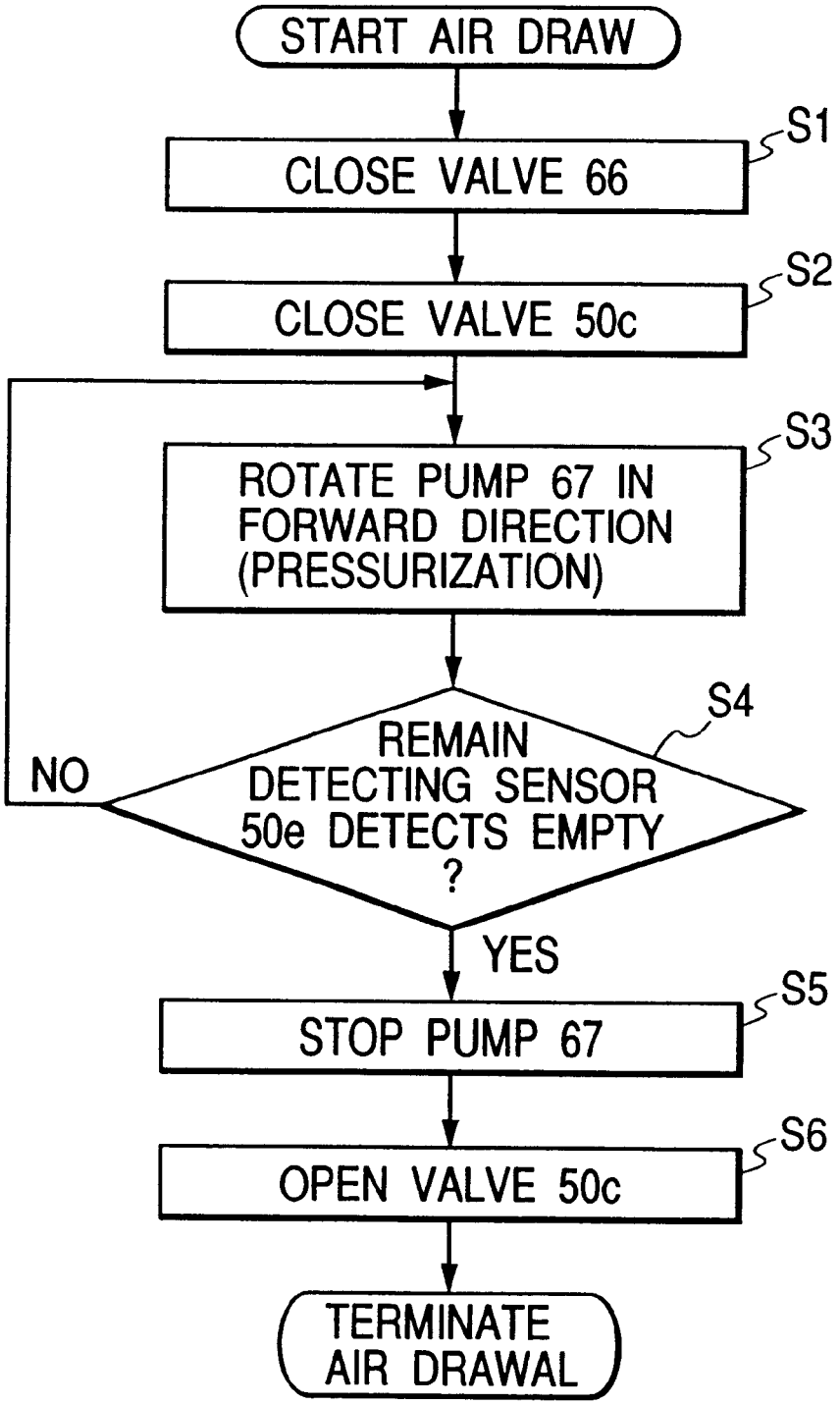
FIGS. 3A and 3B are views which illustrate the operational sequence of the ink jet recording apparatus in accordance with the first embodiment of the present invention.

With no ink in the sub-container (in the sub-ink bladder 50*b*) of the recording head 1, the valve 66 is closed at first (step S1) if the valve 66 is open as shown in FIG. 3A. Then, the open and close valve 50*c* for the atmospheric commutation port is closed (step S2) (here, the valve 65 is open). After that, the suction and compression pump 67 is rotated regularly to pressurize the interior of the case (step S3) until the remainder sensor 50*e* detects that the sub-container is empty. Thus, the air in the sub-ink bladder is exhausted to the outside from the recording head 1. When the remainder sensor 50*e* has detected that the sub-container is empty (step S4), the pump 67 is suspended, and the open and close valve 50*c* for the atmospheric communication port is released. In this manner, the air in the sub-container is deaerated.

(3) The Replenishing Operation between the Main Container and the Sub-container

Figure 3B:
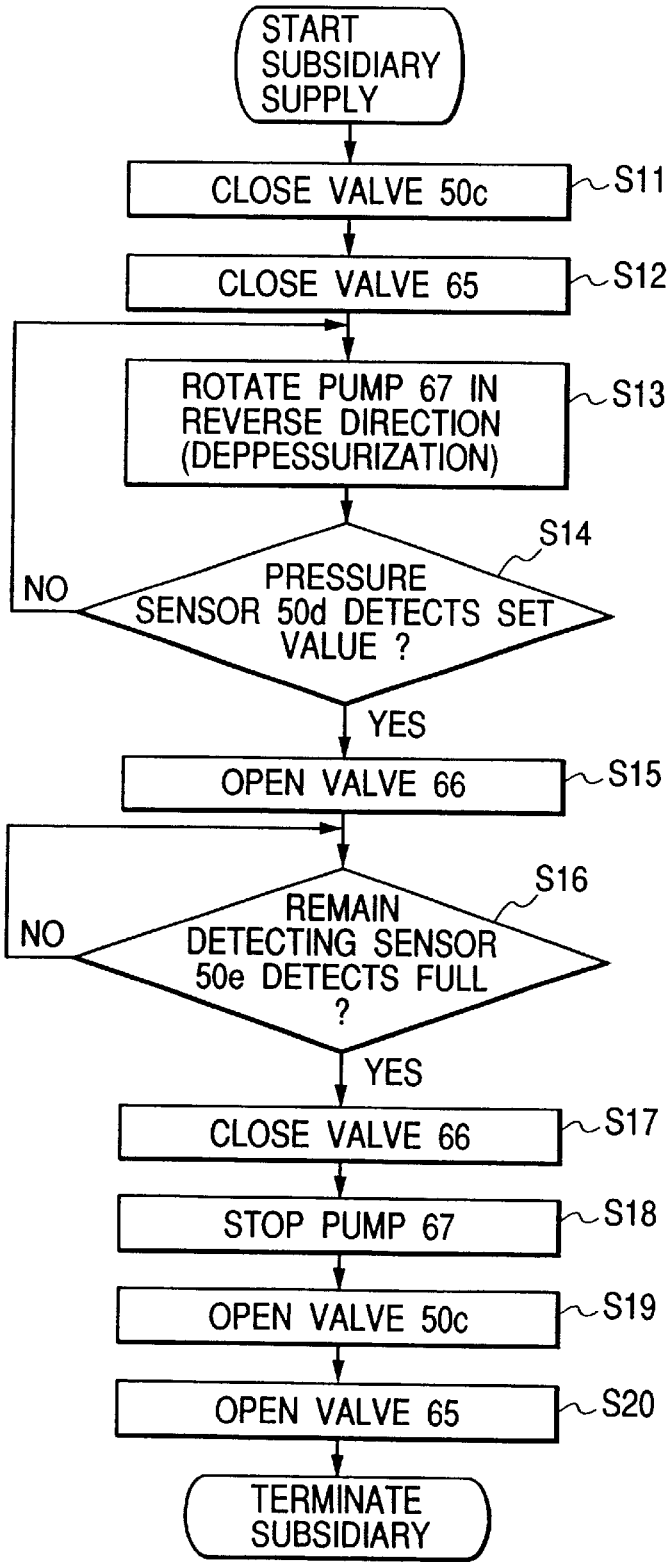

When ink is replenished from the main container to the sub-container as shown in FIG. 3B, the open and close valve 50*c* for the atmospheric communication port is closed (step S11) if this valve 50*c* is open, and then, the second valve 65 is closed (step S12). After that, the suction and compression pump 67 is reversely rotated until the pressure sensor 50*d* indicates the set value, thus reducing the inner pressure of the case. Then, when the pressure sensor 50*d* detects the set pressure (step S14), the first open and close valve 66 is released (step S15). In this manner, ink is supplied from the main container to the sub-container. Here, after the pressure reduction means is driven, the first open and close valve 66 is released to avoid any possibility that ink is caused to flow reversely. Also, in this case, the pressure reduction means for supplying ink to the sub-container is arranged on the path which is made different from the ink supply path by the presence of the sub-ink bladder. As a result, there is no possibility that ink in the ink supply path is contaminated by its passage through the pressure reduction means.

When the remainder sensor 50*e* detects the full container (step S16), the valve 66 serving as the first open and close valve is closed (step S17), and the ink supply to the sub-ink bladder is suspended. Then, the suction and compression pump 67 is suspended (step S18). Thus, the open and close valve 50*c* for the atmospheric communication port is released (step Sl9). The valve 65 serving as the second open and close valve is released (step S20) to finish this sequence. Here, after the first open and close valve is closed, the pump operation is suspended to make it possible to prevent the reverse flow of ink. As means for preventing the reverse flow, it may be possible to install a check valve which allows the movement of ink only in the direction from the main container to the sub-container.

In this respect, if the operation from (2) to (3) described above is continuously performed, it may be possible to modify the sequence so that the process proceeds from the step S5 in the sequence (2) to the step S12 in the sequence (3) instead of executing the sequence (3) after the completion of the sequence (2).

Figure 4:
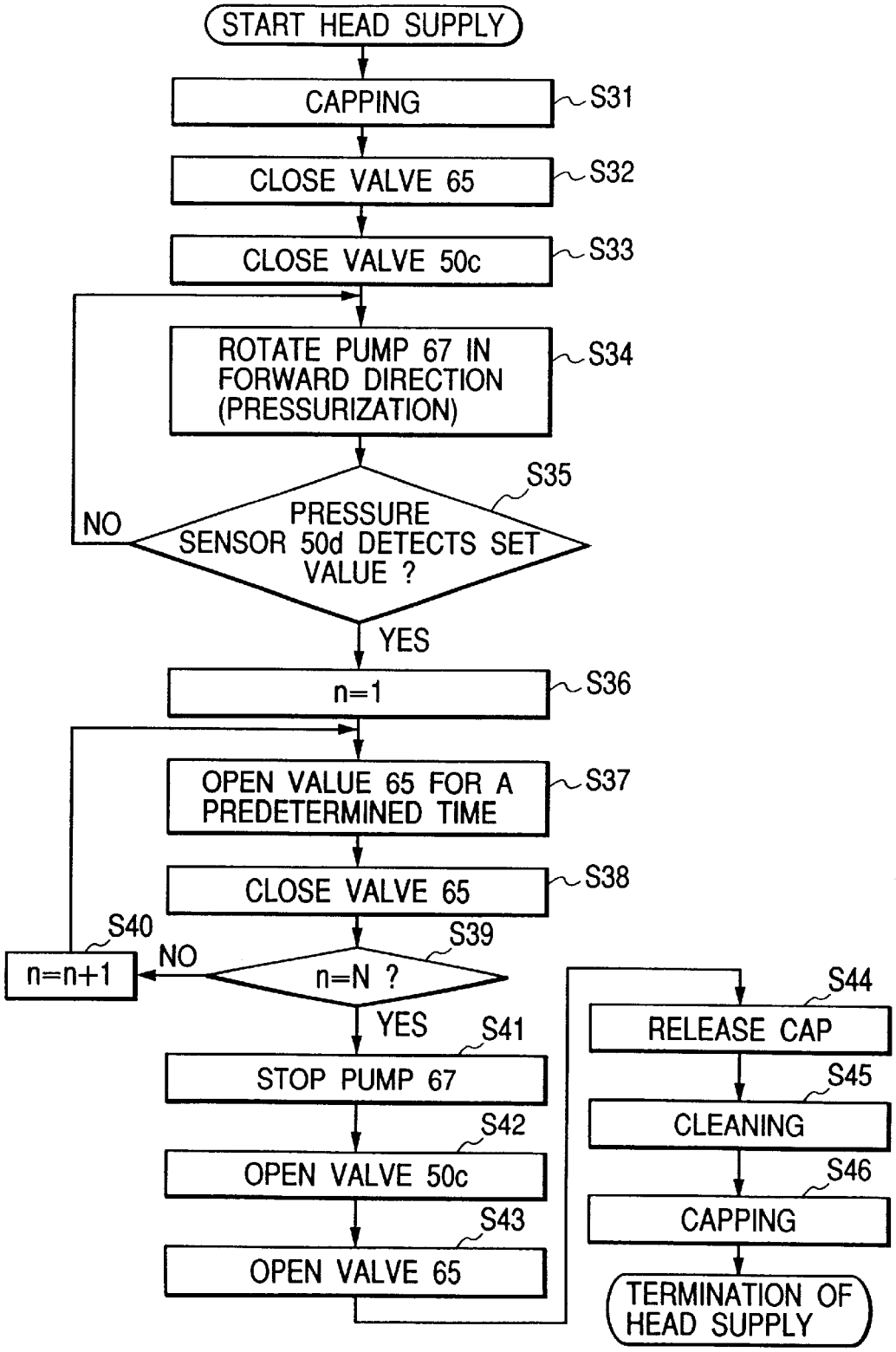
FIG. 4 is a view which illustrates the operational sequence of the ink jet recording apparatus in accordance with the first embodiment of the present invention.

(4) The Compulsory Ink Replenishing Operation from the Sub-Container to the Head For the compulsory ink replenishing from the sub-container to the head, it is arranged, at first, to cap the recording head 1 by the cap members 3 as shown in the flowchart in FIG. 4 (step S31).

Then, the open and close valve 65 is closed (step S32) if this valve 65 is open so as to supply ink to the head 1 by the pressure exerted on the circumference of the sub-ink bladder, and then, the open and close valve 50*c* for the atmospheric communication port is closed (step S33) (at this juncture, the first releasing valve 66 is closed). After that, the pump is regularly rotated until the pressure sensor 50*d* arrives at the predetermined value to enable the interior of the case to be pressurized (step S34). Then, when the pressure sensor 50*d* detects the predetermined value (step S35), the second open and close valve 65 is released (step S37) for a period of the specific time (approximately one second). Then, the closing operation is again executed (step S38). This operation is repeated up to the specific number (N) which has been set in advance (steps S36 to S39). Thus, ink is supplied exactly to each of the nozzles of the recording head. For the ink jet recording apparatus of the present invention, the ink supply to the head is made with the pressurized operation, hence making it possible to implement the compulsory ink replenishing to the head smoothly.

Here, during the compulsory ink replenishing as described above, ink may flow out from the nozzles of the recording head in some cases. Therefore, the recovery pump 16 may be installed in the ink collection path between the caps 3 and the unwanted ink container 134*p* so as to suck only the ink that has leaked to the caps. In this case, the amount of sucked ink becomes smaller than the case where ink is compulsorily replenished to the head only by the sucking operation, thus making it possible to avoid using ink wastefully.

After the compulsory ink replenishing, the pump 67 is suspended (step S41), and the open and close valve 50*c* for the atmospheric communication port is released (step S42), and the second open and close valve 65 is released (step S43). After that, the caps are released (step S44) to perform cleaning by means of the known method, such as using a rubber blade (step S45). After having removed ink on the surface of the recording head, the caps are applied again (step S46), thus terminating this replenishing operation.

In this respect, if the step S36 to step S40 of the operation described above are carried out only once, it becomes the pressurized recovery operation.

As described above, the ink supply path of the ink jet recording apparatus of the present embodiment forms the space closed from the air outside between the main container to the recording head with the exception of each of the nozzles. Therefore, even when the deaerated ink whose dissolved oxygen amounts to 0.5 ppm or less is used, the degree of deaeration is not lowered remarkably in the path.

Now, the detailed description will be made of the ink container in accordance with the present invention.

Figure 6A:
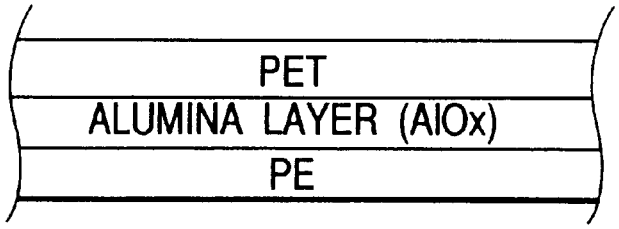
FIGS. 6A, 6B and 6C are cross-sectional views which illustrate the resin film compositions of the ink bladder of the ink cartridge shown in FIGS. 5A and 5B.
Figure 6B:
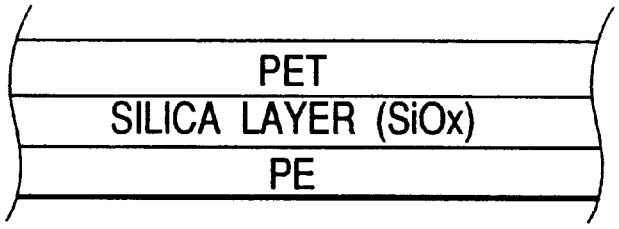
Figure 6C:
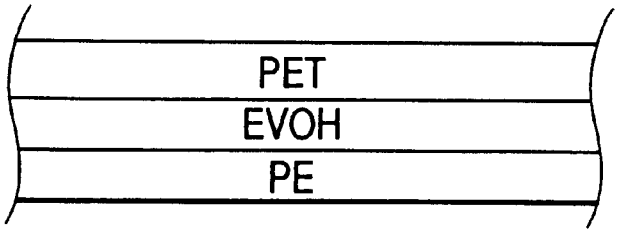

As the film material of the ink bladder 134*a*, it is conceivable, as shown in FIGS. 6A to 6C to adopt the silica deposited film produced by depositing the PET film of 2 μm thick and the PE film of 25 μm thick, respectively, on both sides of the basic layer of silica (SiOx) in a thickness of 0.005 μm, respectively, as shown in FIG. 6B; the alumina deposited film produced by depositing the alumina (AlOx) layer of 0.005 μm thick on the PET film of 12 μm thick with the PE film of 25 μm thick laminated on it as shown in FIG. 6A; or the Everl film (product name) produced by laminating the PET film of 12 μm thick and the PE film of 25 μm thick, respectively, on both sides of the basic layer of ethylene vinyl alcohol copolymer resin in a thickness of 15 μm as shown in FIG. 6C, among some others. Then, the oxygen permeability and the nitrogen permeability are as follows, respectively:

| Deposition | Oxygen Permeability | Nitrogen Permeability |
|---|---|---|
| Silica | 0.5 ppm | 0.1 ppm or less |
| Alumina | 0.2 ppm | 0.1 ppm or less |
| Everl | 0.2 ppm | 0.017 ppm |

Now, the gas permeability is generally expressed in a formula "$q=D\cdot S\cdot A\cdot \Delta p\cdot t/1$", where the q is the gas permeability; the D is the diffusion coefficient; the S is the solubility coefficient; the A is the film area; the t is the time; the Δp is the pressure difference between both sides of the film; and the 1 is the film thickness, and then, the D·S is the gas permeability.

At the time of the ink container manufacture, the gas (mainly, nitrogen 80%, and oxygen 20%) which is dissolved in ink is deaerated, and then, the ink thus deaerated is injected into the ink bladder formed by a film of the kind described above. This product is delivered as an ink container. Usually, the amount of gas in the deaerated ink is indicated by the amount of the dissolved oxygen (mg/l or ppm). Here, it is desirable to ink injected into the ink bladder the deaerated ink whose amount of dissolved oxygen is 0.5 ppm or less.

A deaerated ink of the kind contained in the ink container tends to increase its amount of dissolved oxygen gradually in a long period of time between the delivery and the actual use of the ink cartridge on a printer main body during which the gas (oxygen and nitrogen) or the like in the atmosphere outside the cartridge may permeate the film that forms the ink container.

Figure 7A:
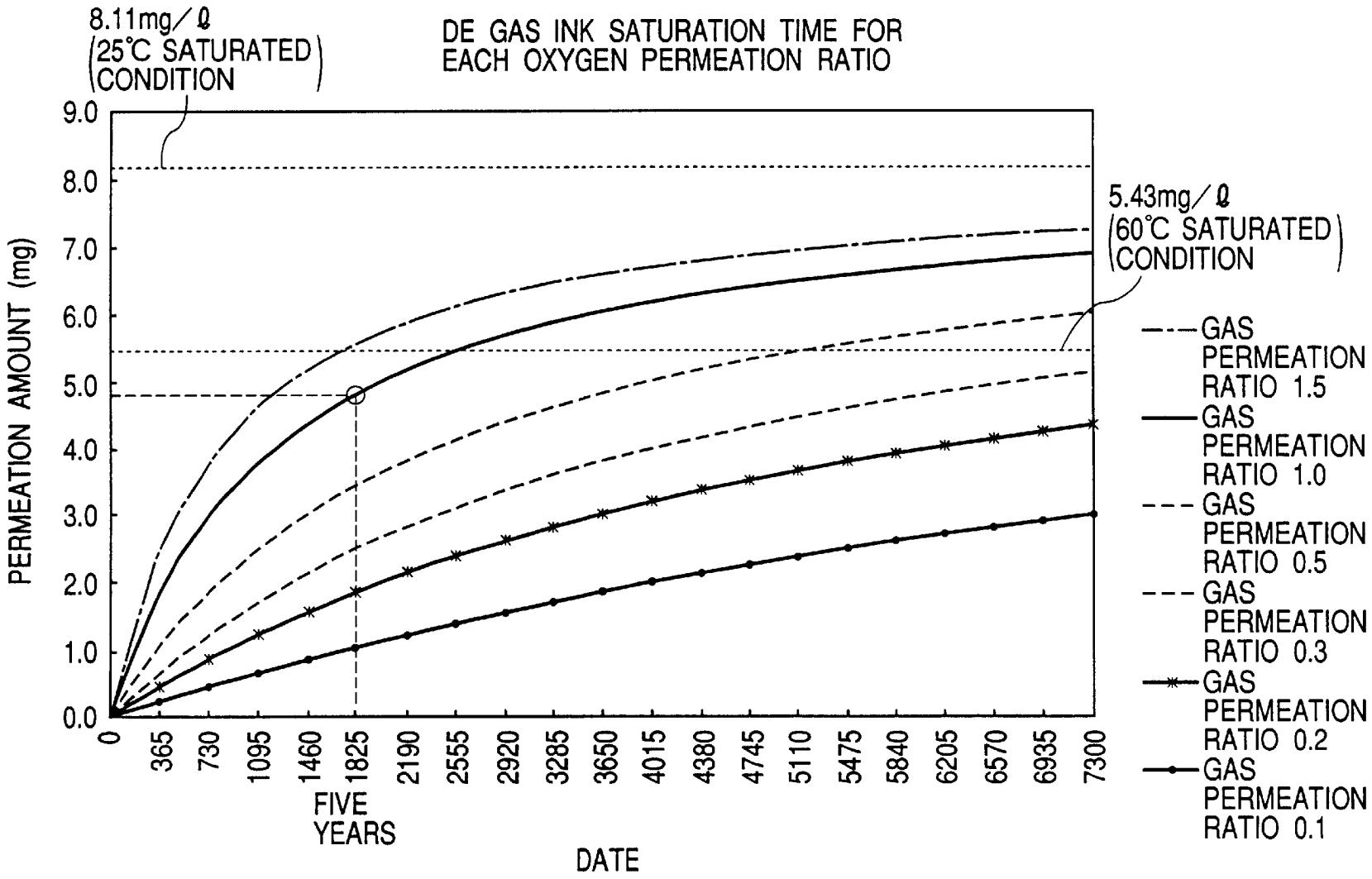
FIGS. 7A and 7B are graphs which illustrate the relationships between the oxygen permeation ratio and the nitrogen permeation ratio of the film material of the ink bladder of the ink cartridge shown in FIGS. 5A and 5B, and the number of days during which the ink cartridge is left intact.

FIG. 7A is a graph which shows the relationships between the ages and the amounts of dissolved oxygen when the ink bladder containing the dissolved ink in it is left intact.

Figure 7B:
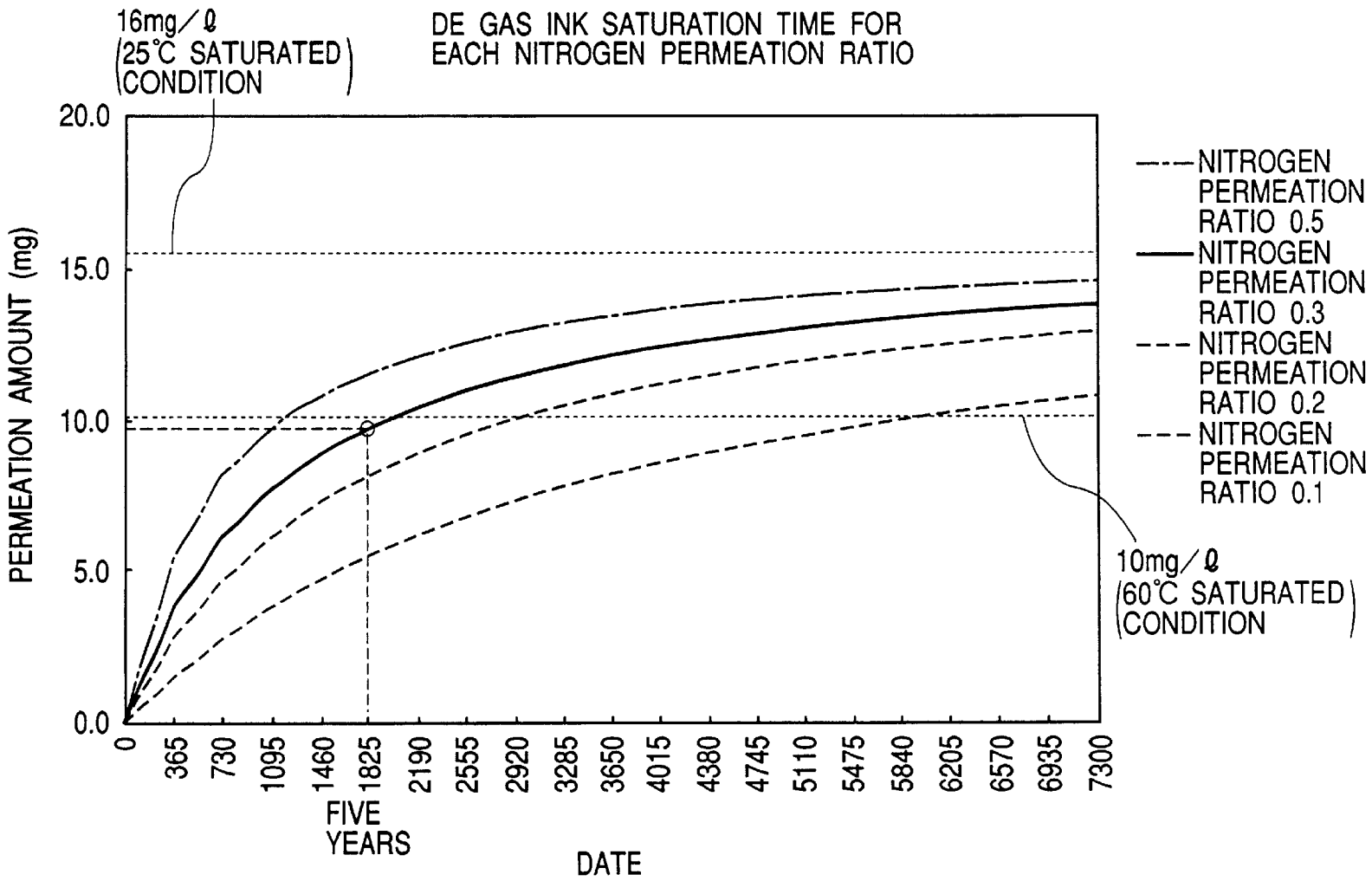

Usually, the guaranteed period of an ink cartridge is within five years. Now, if ink having the dissolved oxygen amount of 0.5 mg/l is injected at 25° C. at the time of manufacture, and left intact for a period of five years, the dissolved oxygen amount in the ink is increased to as high as 5.0 ppm, provided that the gas permeability of the film is 1.5 $cc/m^2 \cdot atm \cdot 24$ hrs. If the external temperature is increased up to 60° C. while the ink bladder is left intact, the dissolved oxygen amount in the ink is 5.48 mg/l at the time of saturation. Then, the oversaturated oxygen amount appears as bubbles in the ink eventually. When such ink is used in the printer main body, the bubbles thus created in the ink are supplied to the recording head together with ink, which causes the clogging in the nozzle unit of the recording head to bring about the defective prints (disabled discharges). Therefore, it is necessary to provide a film whose gas permeability is such that the dissolved oxygen amount does not arrive at the saturation even it is left intact for five years. There is a need for the provision of a film whose gas permeability is 1.0 $cc/m^2 \cdot atm \cdot 24$ hrs or less. Also, likewise, in the case of nitrogen as shown in FIG. 7B, the nitrogen permeability should be 0.3 $cc/m^2 \cdot atm \cdot 24$ hrs or less. In other words, it is required that no bubbles are created in the saturated condition at a temperature of 60° C. It is desirable to make the oxygen permeation amount 5.43 mg/l or less and the nitrogen permeation amount 10 mg/l or less in this condition.

Each of the above mentioned films (silica film, alumina film, or the like) satisfies these conditions sufficiently, and even if it is left intact for a period of five years, ink can maintain the deaerated state continuously. As a result, the deaerated ink is supplied to the recording head when prints are made by the printer main body, thus making it possible to dissolve bubbles in the ink flow paths into the ink. In this manner, no print defects (disabled discharges) take place due to bubbles to reduce the frequency of non-discharges. Each of the above mentioned films is, therefore, most suitable as the resin material to be used for the ink container film.

Here, the gas permeability is reversely in proportion to the film thickness. It is of course possible to make the film thickness greater. For example, if the PVDC is used as the material, the oxygen permeability is 10 $cc/m^2 \cdot atm \cdot 24$ hrs where the film thickness thereof is 25 $\mu$m. In order to make the oxygen permeability 1.0 $cc/m^2 \cdot atm \cdot 24$ hrs or less, the thickness of the PVDC should be made 250 $\mu$m or more.

In this manner, the oxygen permeability and the nitrogen permeability can be made smaller with the thicker film of the ink bladder. With the ink container formed by the single layered film, there is no need for the performance of the secondary process in which plural films should be laminated, hence making it possible to implement the cost reduction.

Figure 8A:
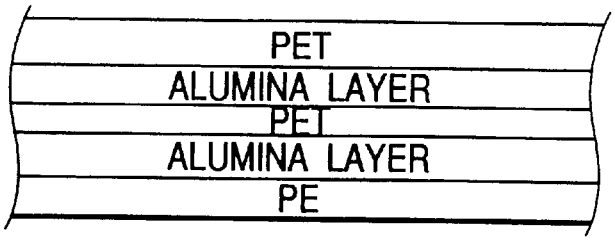
FIGS. 8A, 8B and 8C are cross-sectional views which schematically illustrate the variational example of the resin film compositions of the ink bladder of the ink cartridge shown in FIGS. 5A and 5B.
Figure 8B:
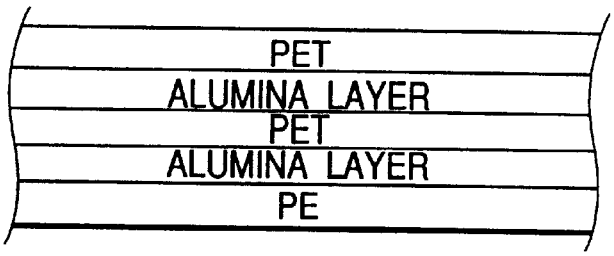
Figure 8C:
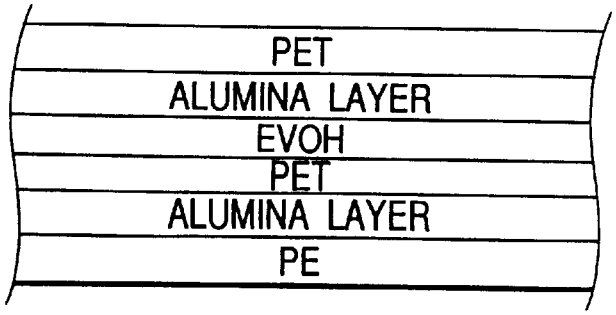

Also, in order to make the gas permeability smaller for the resin film, it is possible to arrange the "PET-AlOx" film in two layers as shown in FIGS. 8A to 8C to form the structure of the "PET-AlOx-PET-AlOx-PE (the thickness: 12+0.05+12+0.05+25=49.01 $\mu$m)", for example.

Usually, the AlOx film (alumina deposition film) is processed as a film formed by the PET with the deposited AlOx, and then, the PE film is laminated on it as the post process. Therefore, the above-mentioned "PET-AlOx-PET-AlOx-PE" film is formed by laminating the two "PET-AlOx" films with the PE or the like which is laminated subsequently.

With the double layered alumina film thus structured, it becomes possible to reduce the gas permeability by 30%, and the oxygen permeability of the double layered alumina deposition film is 0.14 $cc/m^2 \cdot atm \cdot 24$ hrs. Then, the gas permeability thereof becomes close to that of the aluminum foil. Also, for the film structured as described above, it may be possible to provide the silica deposited double layered film or to laminate the Everl film further, among some other process.

As described above, with the lamination of resin film in plural layers, it is possible to make the gas permeability smaller for the ink bladder, thus enhancing the effect against the disabled discharges that may be caused by the bubbles of the deaerated ink. Further, by use of the resin film, the ink bladders can be incinerated for disposition after the ink cartridges are used.

For the ink jet recording apparatus of the present embodiment, ink is supplied from the main container to the sub-container by means of a pump. Thus, it is unnecessary to consider the water head difference and the balance of the negative pressure between the ink container and the recording head. Therefore, even if the ink container is formed by the flexible resin material for the recycling convenience, it is possible to adopt, in consideration of the gas permeability, the thick ink bladder having a large changes of negative pressure along with the outlet of ink or having a higher negative pressure at the ink supply outlet. More specifically, even if the ink container has the negative pressure of −200 mmAq. or less (that is, a large negative pressure) at the ink supply port of the ink container at the initiation of its use, it is possible to use such ink container sufficiently. Also, it is possible to use the ink container whose absolute value of the negative pressure difference is 300 mmAq. or more at the ink supply port of the ink container at the time of initiation of its use and the termination thereof (the status where the ink container can no longer be usable: here, it is assumed that the ink container is at its termination when the ink container cannot be used any longer even if ink is still contained in the ink container). (In other words, it is possible to use the ink container whose negative pressure is 200 mmAq. at the time of initiation of its use, but −500 mmAq. (a large negative pressure) at the time of its termination of use.) In this manner, it becomes possible to use an ink container whose structure is not simply an ink container bladder, but three dimensional (a square column type, for instance). As a result, there is an advantage to increase the efficiency as to the space occupied by the ink container in an ink container.

For an ink container of the kind whose negative pressure is 200 mmAq. or less at the ink supply port at the time of its initiation of use, it is possible to form its ink bladder with resin material in terms of the ink bladder as a single body, which can be incinerated for disposition or easily utilized for recycling. Also, there is an advantage that with the higher negative pressure at the initiation and the higher robustness of the material itself that forms the bladder, the ink leakage rarely takes place due to the damage caused on the seal or the like in the ink supply port portion by shocks or the abrupt environmental changes during the delivery (usually, the ink supply port portion is sealed by a sealing member). An ink container of the kind can be utilized not only for the ink jet recording apparatus provided with the sub-container of the present invention, but also, utilized for the ink jet recording apparatus which is provided with a pump in the liquid supply route to execute the liquid supply to the recording head by use of such pump.

Second Embodiment

Figure 9:
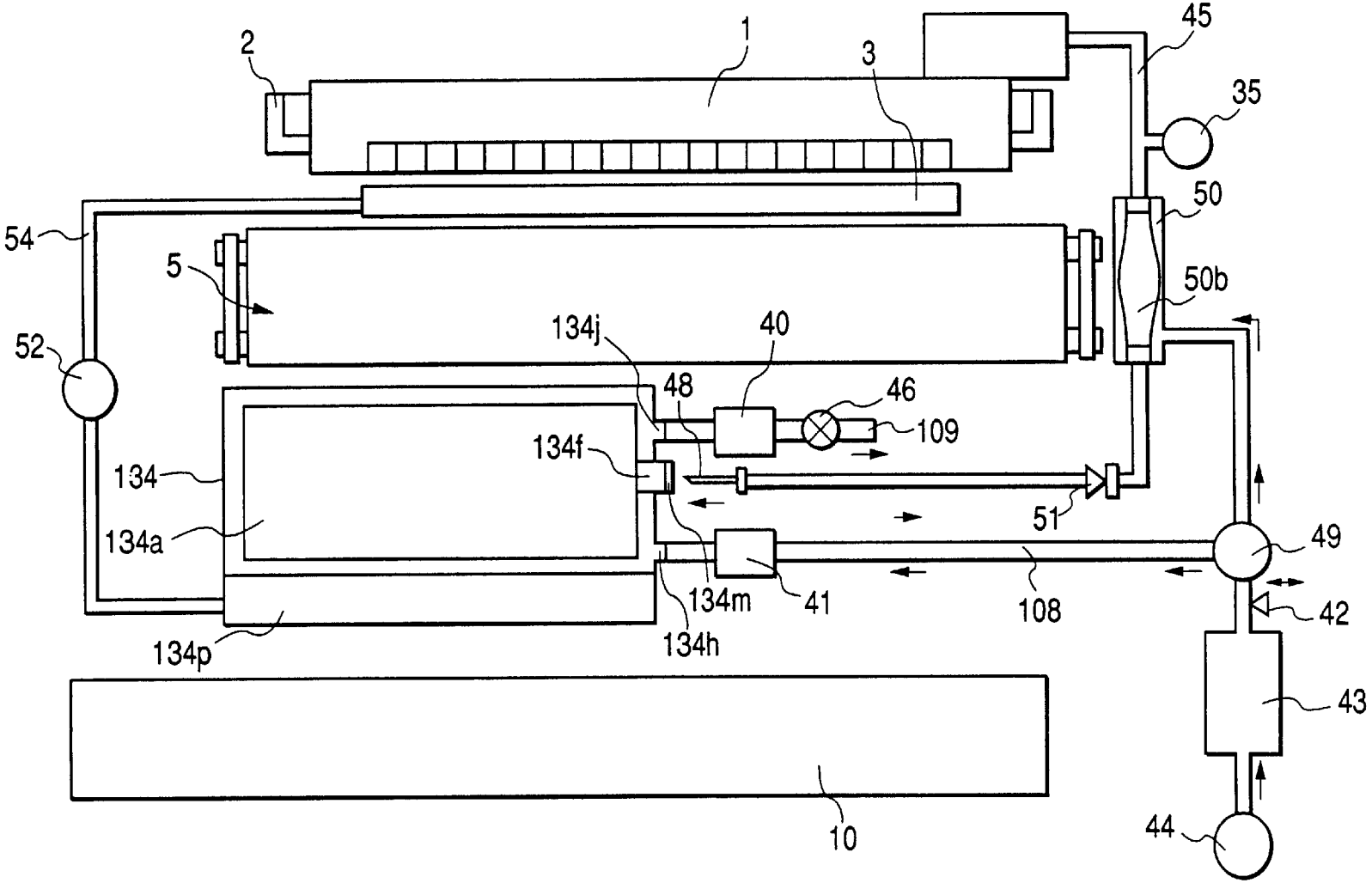
FIG. 9 is a view which illustrates the ink supply paths of the ink jet recording apparatus in accordance with a second embodiment of the present invention.
Figure 10:
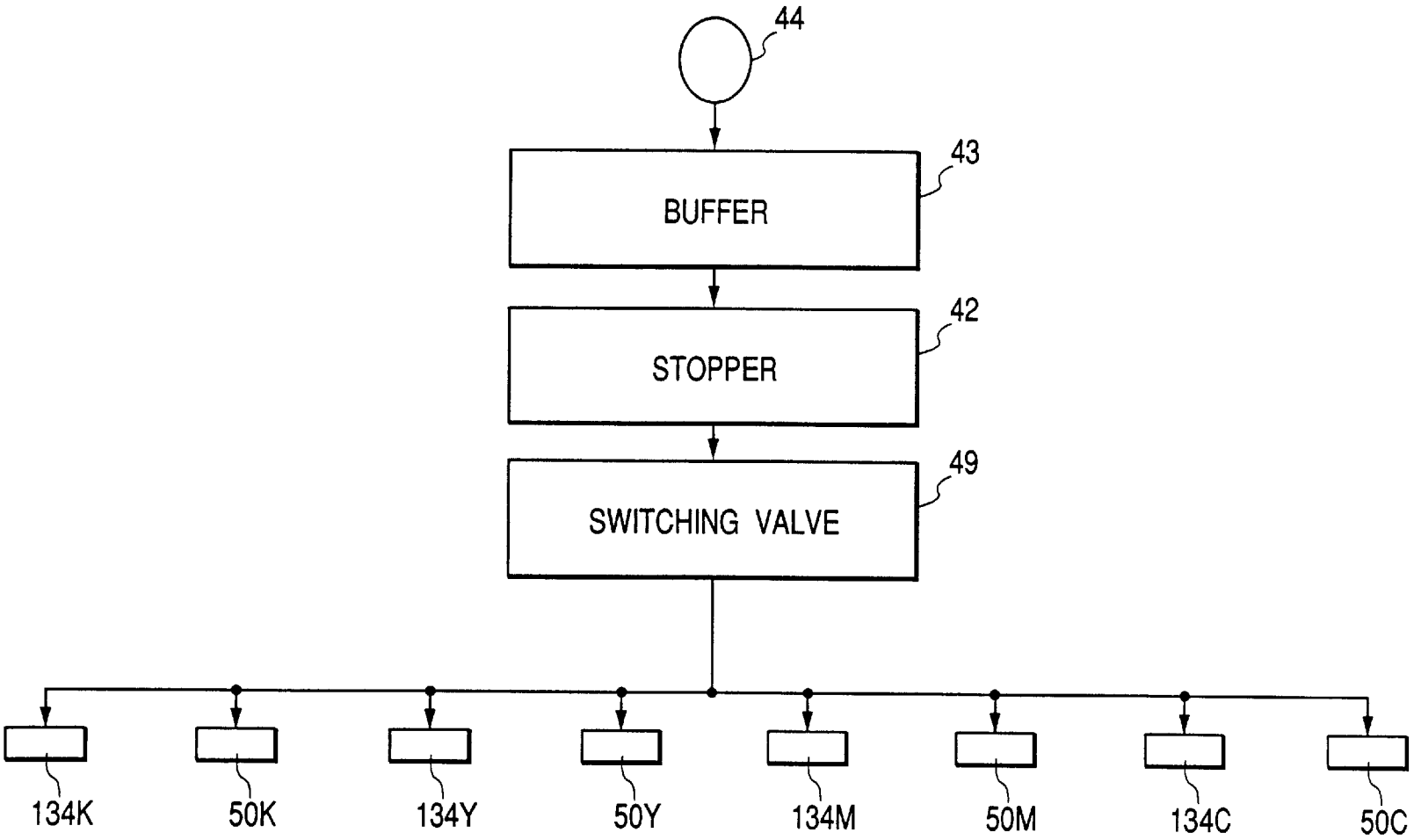
FIG. 10 is a block diagram which illustrates the gas flow path to enable the ink containers and sub-containers to be pressurized in accordance with the second embodiment of the present invention.

FIG. 9 is a cross-sectional view which shows the right side of the ink jet recording apparatus in accordance with a second embodiment of the present invention. FIG. 10 is a block diagram which shows the ink supply recovery device. In accordance with the present embodiment, the ink container 134 is of such a structure that the ink bladder 134*a* that contains ink in it is covered by the covering containers 134*d* and 134*n*, for example, in the same manner as the ink container of the first embodiment described in conjunction with FIG. 5B. Here, in accordance with the present embodiment, the cover container 134*n* is formed by the flexible sheet substantially in the same configuration as the cover container 134*e*. For the material of the sheet 134*n*, it is most suitable to use a sheet material which is produced by laminating nylon and PE, respectively, on both faces of the aluminum film having the lower gas permeability; the Everl (a product name of the Kurare K. K.: ethylene vinyl alcohol copolymer resin film laminated with some other resin); or the like. However, some other material may be usable without problem.

The bonded portion between the cover containers 134*d* and 134*e* of the ink container 134 is sealed with the sealing material in order to prevent gas from leaking any places other than the exhaust port 134*j* and the pressure port 134*h*. Here, a reference numeral 134*f* designates the ink supply port through which ink is exhausted externally from the ink bladder 134*a*.

When the ink container 134 is mounted on the recording apparatus main body, the pressure port 134*h* of the ink container 134 is connected with the joint 41 of the recording apparatus main body. At the end of the joint 41, the buffer 43 is connected to retain the gas, such as the air, and then, at the end of the buffer 43, the pump (pressure recovery means) 44 is connected to send the air to the interior of the buffer 43. As the pump 44, the tube pump is most suitable, but a pump of any other type may be usable. Also, the stopper 42 is arranged between the pressure port 134*h* and the buffer 43. Then, the structure is arranged so that the stopper 42 is released when the interior of the buffer 43 is pressurized to a certain level in order to prevent the air from flowing into the ink container 134 when the air is retained in the buffer 43. The stopper 42 is structured to block the flow path of the rubber tube by pressing the roller on the tube by the application of spring force, and then, to switch the releasing or the like by turning on and off the solenoid (this structure is not shown).

For the pipe 108 that connects the ink container 134 up to the pump 44, it is most suitable to use a rubber tube formed by flexible material, because the pump 44 is the tube pump, and also, the stopper 42 is arranged between the buffer 44 and the pressure port 134*h*.

Here, the switching valve 49 is arranged on the downstream side of the stopper 42 (see FIG. 10) to switch the containers to be pressurized with the air by use of the pump 44: (the containers to be switched over are: four color ink containers 134K, 134Y, 134M, and 134C, and the sub-containers 50K, 50Y, 50M, and 50C to be described later). As the switching valve 49, the spool type switching valve, the disc type switching valve, or the like is used. However, some other type switching valve may be usable without problem.

When the ink container 134 is mounted on the recording apparatus main body, the exhaust port 134*j* of the ink container is connected with the joint 40, and connected with the exhaust port 109 to exhaust the gas sent by the pump 44 to the interior of the ink container. The open and close valve 46 is arranged on the way to switch the flow path to be blocked or communicated.

The ink container 134 is connected with the recording head 1 by means of the ink supply tube 45. On the intermediate portion, the sub-container 50 is arranged to reside including the sub-ink bladder 50*b*. The sub-ink bladder 50*b* is formed by aluminum foil or some other flexible material as the ink bladder 134*a*, which functions to hold the menisci of ink in the recording head 1.

On the way of the ink supply tube 45 between the ink container 134 and the sub-container 50, the one-way valve 51 is arranged. As the one-way valve 51, a bevel valve, a check valve, or the like is usable, but some other type one way valve may be usable without problem. The pressure sensor 35 is arranged between the recording head 1 and the sub-container 50.

Here, in order to prevent the creation of bubbles or in order to use the deaerated ink effectively, it is preferable to form all the ink supply tubes 45 with a material having the good gas-barrier property between the ink container 134 and the recording head 1.

The ink container 134 is positioned below the recording medium carrying means 5, and usually in a height at which the menisci of the nozzle unit of the recording head 1 is not allowed to be held (the height difference of 100 mm or more between the ink container and the recording head). However, in accordance with the present embodiment, the sub-container 50 is arranged, and the heights of the recording head 1 and the sub-container 50 are set in the relationship of 0 mm<(the height of the recording head 1)−(the height of the sub-container 50)<100 mm so that the menisci can be held at the nozzle unit of the recording head 1, and at the same time, it is made possible to exert the negative pressure that does not produce any adverse effect on printing. Also, the one-way valve 51 prevents ink from reversely flowing into the ink container 134 due to the pressure difference that may be created by the height difference between the ink container 134 and the sub-container 50.

Now, the description will be made of the ink supply and recovery operations in accordance with the present embodiment.

when the ink bladder 134*a* of the ink container 134 is pressurized by use of the pressure pump 44, ink in the ink bladder 134*a* is supplied to the sub-container 50. The amount of the ink supply to the sub-container 50 is adjustable in such a manner that the pressure in the sub-ink container 50*b* is detected by the pressure sensor 35, and then, the amount of ink in the sub-ink bladder 50*b* is recognized in accordance with the pressure thus detected, and that if a sufficient amount of ink is obtained , the valve 46 is released to suspend the pressurized supply of ink from the ink bladder 134*a*. In this way, when the sub-ink bladder 50*b* of the sub-container 50 where an appropriate amount of ink has been supplied is pressed by use of the pressure pump 44, ink in the sub-ink bladder 50*b* is supplied to the recording head 1.

When the ink jet recording apparatus operates a continuous printing, the bubbles, which are created mainly to discharge ink, are allowed to remain in ink to block ink in the interior of each nozzle of the recording head 1 if such bubbles are developed, hence leading to the disabled discharges. To avoid the occurrence of this even, the pump 44 is communicated with the sub-container by means of the switching valve 49 shown in FIG. 10. Then, while closing the stopper 42, the pump 44 is actuated to retain the air in the air buffer 43 to make it highly pressurized. Then, when the stopper 42 is released, the air in the air buffer 43 is sent out to the interior of the sub-container 50 to press the sub-ink bladder 50*b*. Ink in the sub-ink bladder 50*b* is allowed to flow into the recording head 1 under the pressure exerted by the air, hence making it possible to cause ink and bubbles or the like in ink to flow out from the nozzle unit of the recording head 1 for the execution of the pressurized recovery operation of the recording head 1. Immediately after this pressurized recovery operation, the exhaust port 109 is released. In this manner, the amount of the unwanted ink consumed by the pressurized recovery is made smaller.

When the pressure of ink is detected by the pressure sensor 35, it becomes possible to sense the ink remainders in the sub-container 50 (because if the ink remainders in the sub-container 50 become smaller, the pressure in the ink supply tube 45 becomes lower). This detection may indicate whether or not the menisci are held in the nozzle unit of the recording head 1, and also, makes it possible to measure the pressure exerted on ink at the time of the recovery operation. Hence, an appropriate recovery operation can be executed. Also, if ink cannot be exhausted due to the clogging of the nozzles of the recording head 1 at the time of the pressurized recovery, the pressure sensor 35 detects any excessive pressure to suspend the pressurizing operation for the prevention of accidental occurrence, such as the breakage of the ink bladder 134*a*, among some others.

Third Embodiment

Figure 11:
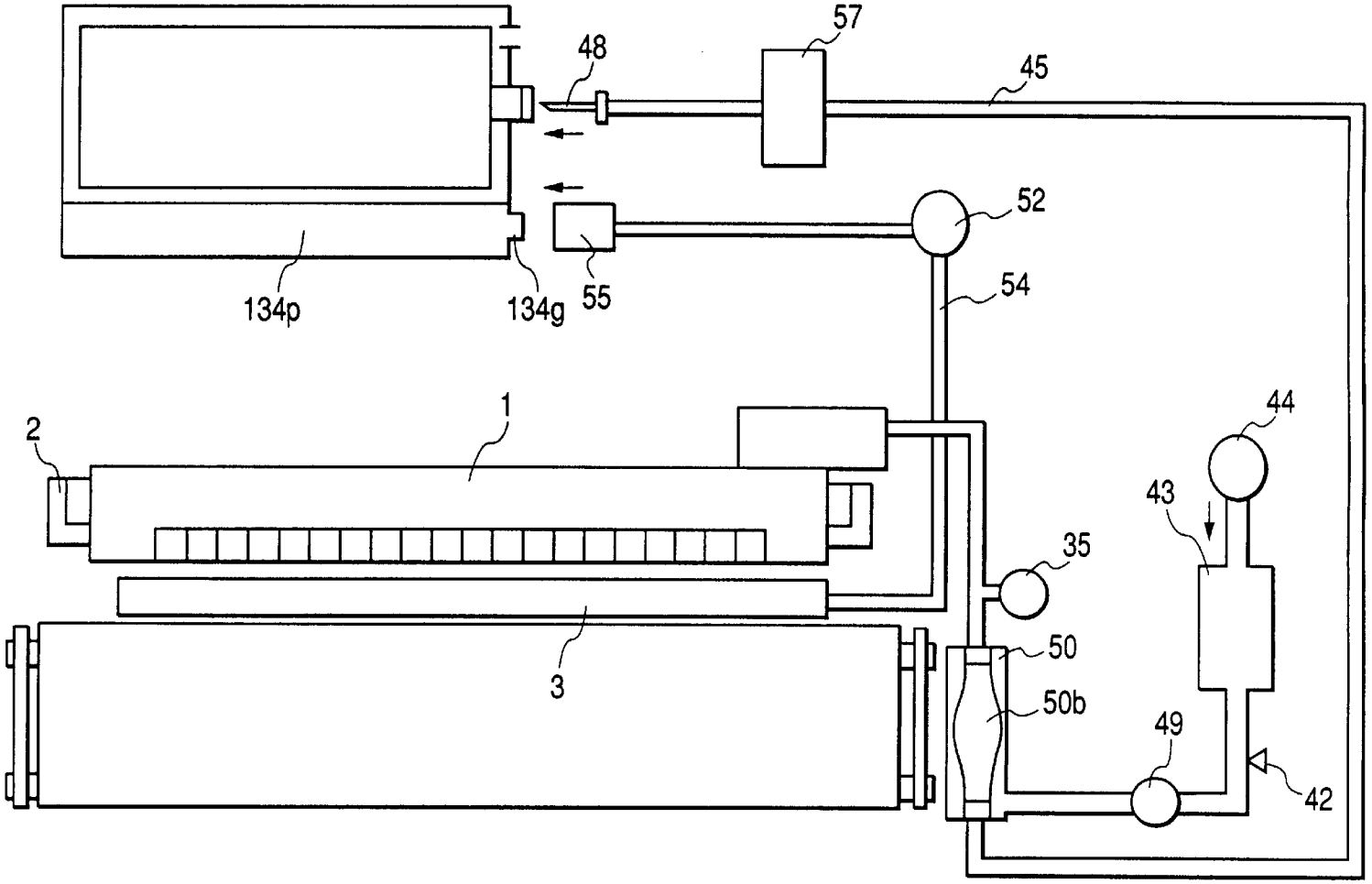
FIG. 11 is a view which illustrates the ink jet recording apparatus in accordance with a third embodiment of the present invention.

FIG. 11 is a view which shows the right side of the ink jet recording apparatus in accordance with a third embodiment of the present invention.

For the present embodiment, the arrangement is made so that the ink container 134 that contains the same ink bladder 134*a* as that of the second embodiment is positioned above the recording head 1.

Then, the valve 57 is arranged between the recording head 1 and the sub-container 50 to open and close the ink supply tube 45. The valve 57 is released when ink is supplied from the ink container 134 to the sub-container 50. Then, ink in the ink bladder 134*a* is allowed to shift to the sub-ink bladder 50*b* by the pressure exerted by the water head difference between the ink container 134 and the sub-container 50. At this juncture, the pressure detection sensor 35, which is arranged on the way of the ink flow path, makes it possible to detect the ink remainders in the sub-ink bladder 50*b*. Thus, if it is confirmed that the sufficient amount of ink is retained in the sub-ink bladder 50*b*, the valve 57 is closed to finish the ink supply operation to the sub-ink bladder 50*b*.

Also, at the time of the ink supply and recovery operation of the recording head 1, the air is sent into the interior of the sub-container 50 by use of the pump 44, and then, by squeezing the sub-ink bladder 50*b*, ink is supplied to the recording head 1 for the operation of the pressurized recovery.

Also, the cap 3 and the collection port 134*q* of the collection unit 134*p* of the ink container 134 are communicated through the communication tube 54, the pump 52, and the joint 55. Then, by the operation of the pump 52, ink retained in the cap 3 is collected to the collection unit 134*p* through the communication tube 54, the joint 55, and the collection port 134*q*.

With the structure described above, the ink supply from the ink container to the sub-container is performed only by means of the valves without using any special driving source. As a result, it becomes possible to make the apparatus simpler at lower costs.

Fourth Embodiment

Figure 12A:
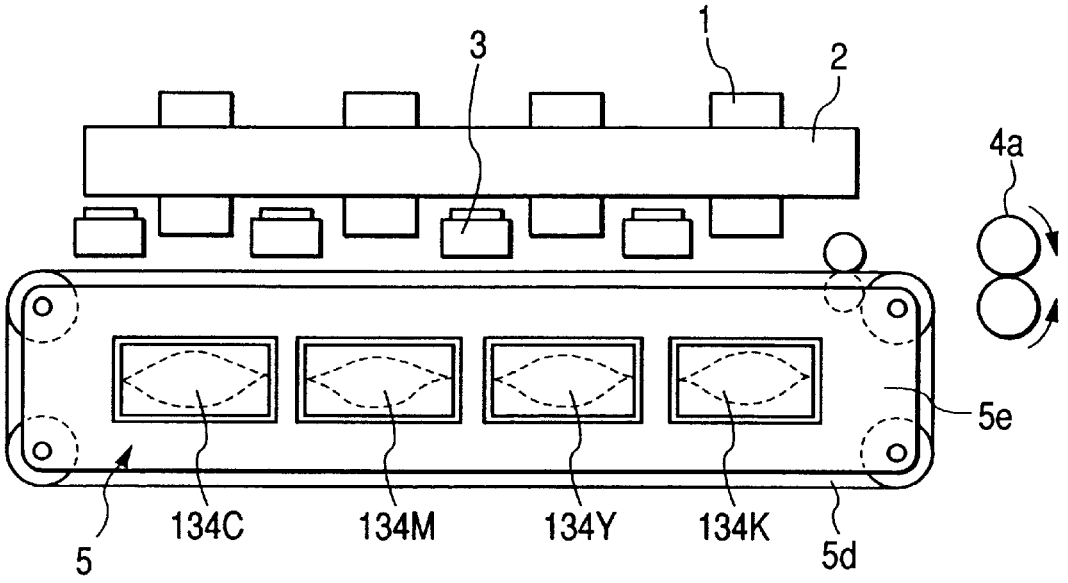
FIGS. 12A and 12B are views which illustrate the ink jet recording apparatus in accordance with a fourth embodiment of the present invention.
Figure 12B:
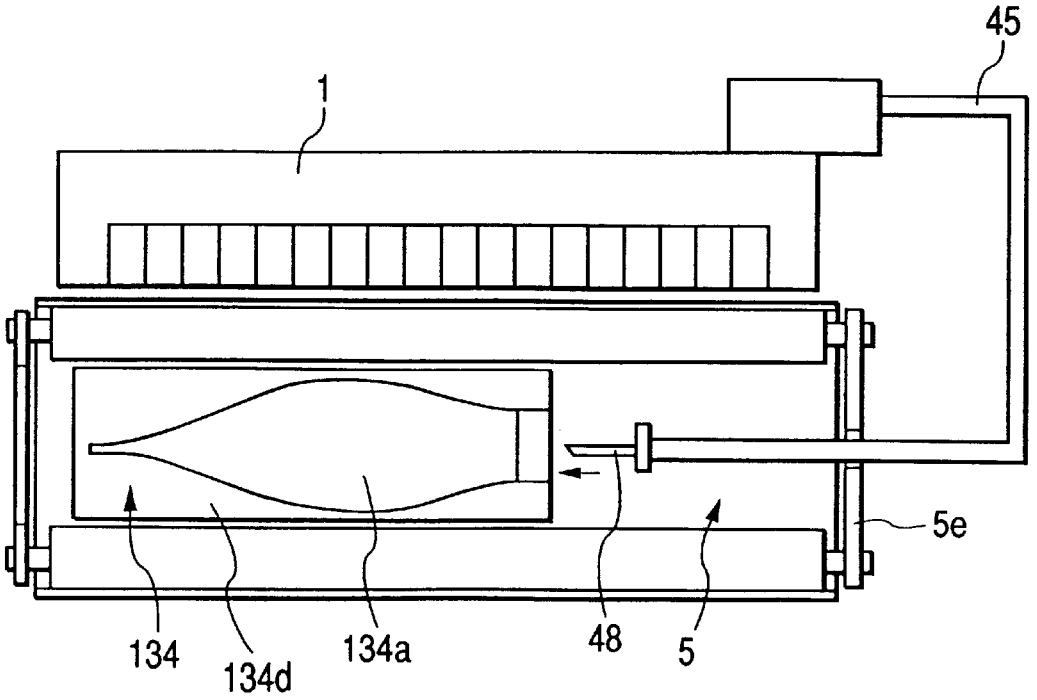

FIG. 12A and FIG. 12B are views which illustrate the front side and the right side of the ink jet recording apparatus in accordance with a fourth embodiment of the present invention. For the present embodiment, the insertion guide (not shown) are formed to detachably mount the ink container 134 on the housing 5*e* with the structure which is arranged to enable the housing 5*e* of the recording medium carrying means 5 to contain the ink container 134.

Also, the ink supply needle 48, which is connected with the ink supply tube 45, is incorporated in the housing 5*e* to communicate the ink bladder 134*a* with the ink supply tube 45 when the ink container 134 is mounted in the housing 5*e*. With the ink supply needle 48 which is pierced into the ink supply port 134*f* (sealed with an elastic material such as rubber) of the ink bladder 134*a* at the time of mounting the ink container 134, ink in the ink bladder 134*a* of the ink container is supplied to the recording head 1 through the ink supply tube 45.

In accordance with the present embodiment, the ink container 134 is incorporated in the recording medium carrying means 5 to satisfy the condition needed for the ink meniscus holding in the recording head 1 by means of the water head difference between the ink container 134 and the recording head 1, that is, 0 mm< (the face height of the recording head 1–the height of the ink container 134)<100 mm. Thus, the normal printing operation becomes possible. Further, the area occupied by the recording apparatus main body is made smaller. Here, it is of course possible to apply the sub-container and pressure adjustment means described in each of the previous embodiments to the present embodiment. In such a case, there is no need for adjusting the water head difference by use of the main container.

Here, in accordance with the present embodiment, it may be possible to perform the ink supply and recovery operation of the recording head 1 by means of either the pressure roller, the pressure exerted by fluid which will be described later, or some other pressurizing means.

Fifth Embodiment

In accordance with each of the first to third embodiments described above, the pressure adjustment means is provided for the sub-container. However, for the present embodiment, the sixth embodiment, and the seventh embodiment, the description will be made of the structure in which the pressure adjustment means is provided for the main container. Each of these embodiments is an excellent invention itself individually, and at the same time, it becomes possible to demonstrate the multiplier effect on each of the technical problems if each of them is combined with the first to fourth embodiments, respectively.

Figure 13:
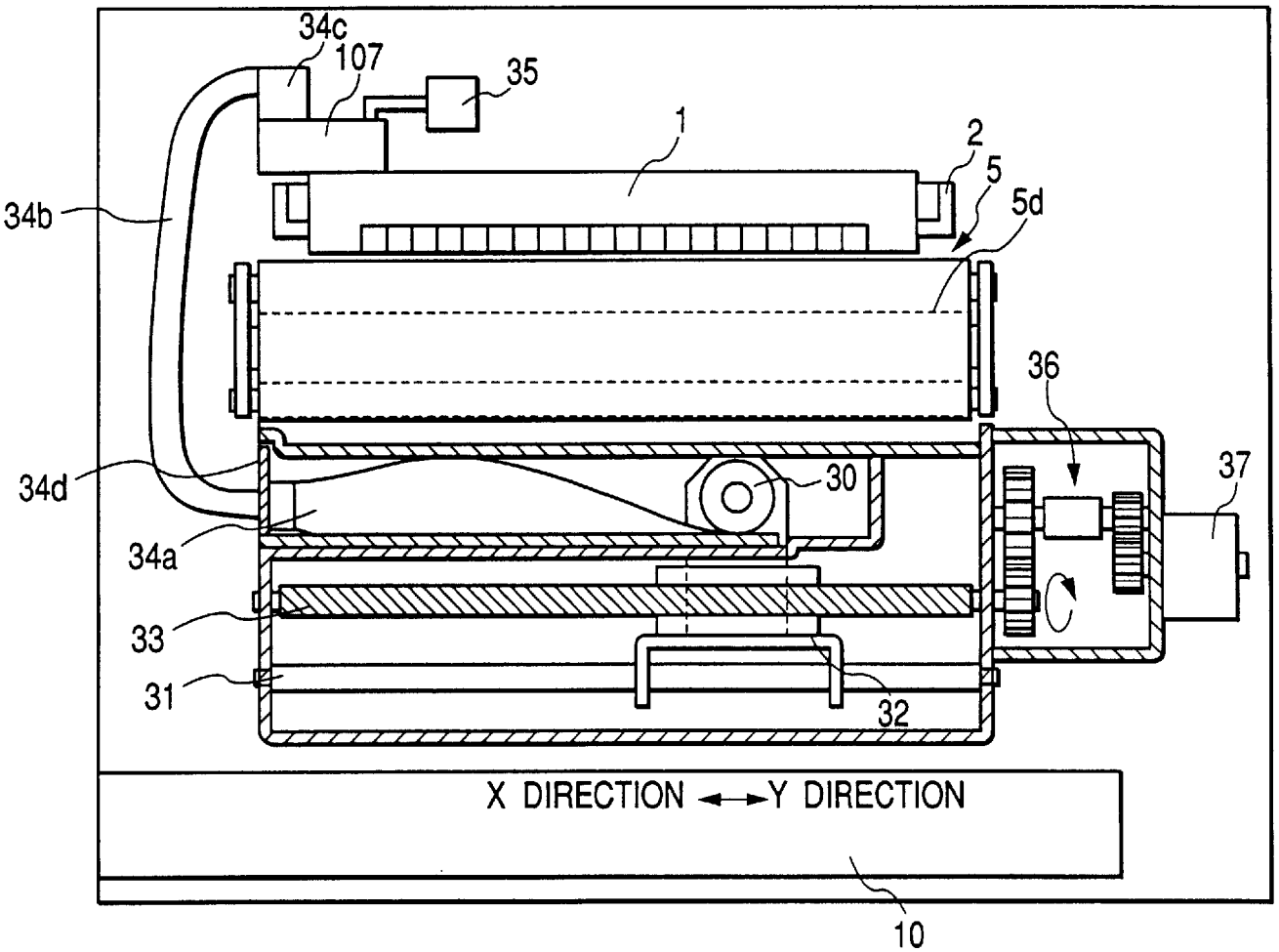
FIG. 13 is a view which illustrates the ink jet recording apparatus in accordance with a fifth embodiment of the present invention.
Figure 14A:
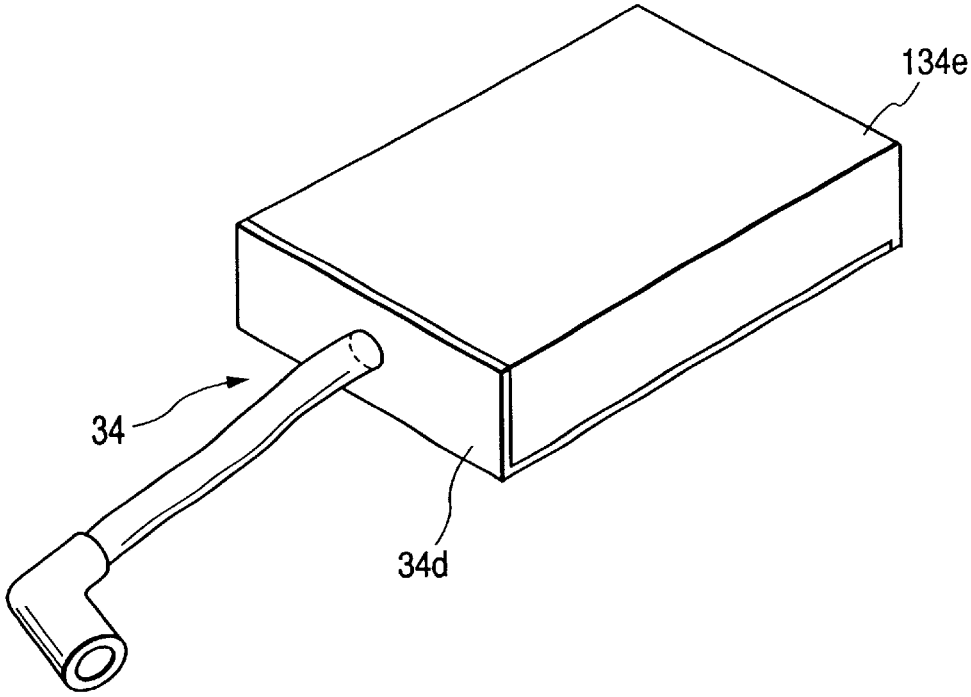
FIGS. 14A and 14B are perspective views which illustrate the ink container of the ink jet recording apparatus shown in FIG. 13.
Figure 14B:
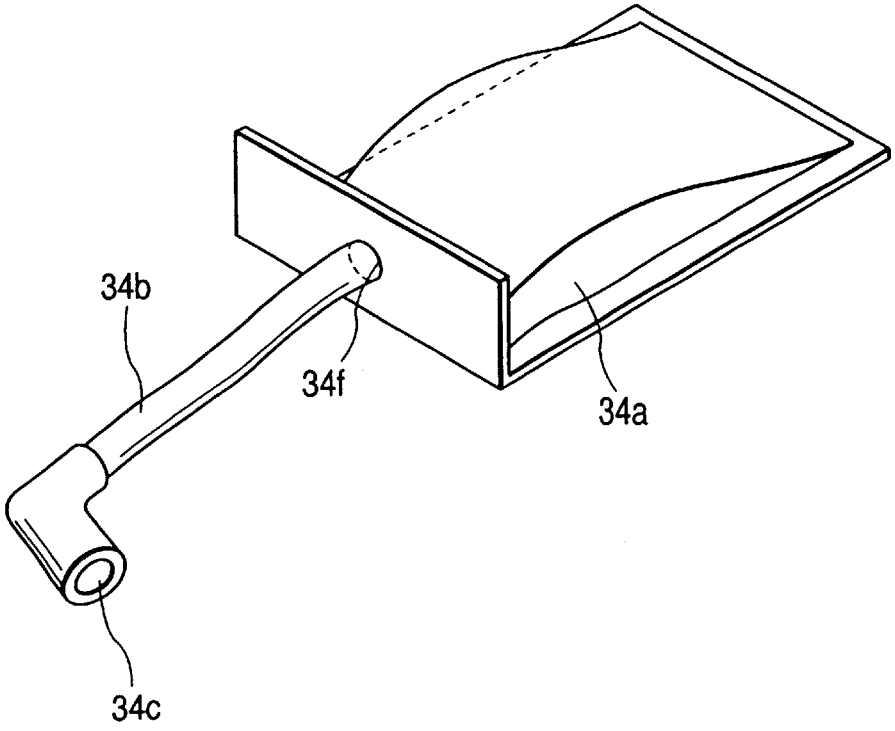

FIG. 13 is a side view which show the ink jet recording apparatus in accordance with the fifth embodiment of the present invention. FIGS. 14A and 14B are perspective views which show the ink container 34 in accordance with the fifth embodiment of the present invention.

As shown in FIGS. 14A and 14B, the ink container 34 is structured to cover the flexible ink bladder 34*a* that contains ink with the cover containers 34*d* and 34*e*. As the material of the ink bladder 34*a*, it is preferable to use a flexible material having the lower gas permeability. For example, the material is produced by laminating the nylon of 15 μm thick on the surface of the aluminum film base of 9 μm thick, and the polyethylene (PE) of 60 μm thick on the reverse face thereof, respectively, for example. This ink bladder 34*a* is formed by fusing the PE themselves on the circumferential edges of the reverse sides of the two aluminum films by means of heat sealing. In this respect, the ink supply port 34*f* formed by PE is arranged on a part of the edge portion that surrounds the ink bladder 34*a*. The ink supply port 34*f* is provided with the joint 34*c* which is connected with the recording head 1 through the flexible ink supply tube 34*b*. The joint 34*c* is structured with the valve (not shown) through which to supply the ink in the ink bladder 34*a* to the interior of the recording head 1 only when it is connected with the recording head 1 but not to allow ink in the ink bladder 34*a* to leak when it is not connected with the recording head 1. Also, the flexible ink supply tube 34*b* should preferably be formed by a material having a lower gas permeability, such as fluororesin (PVDF or the like). However, some other materials may be usable. Although the ink container 34 is in such a state where the ink bladder 34*a* is covered by the cover containers 34*d* and 34*e* (as shown in FIG. 14A) when it is not mounted on the recording apparatus main body as described earlier, the ink cover container 34*e* is removed from the ink container 34, and then, the ink bladder 34*a* is in the state of being exposed when the ink container is mounted on it (as shown in FIG. 13 and FIG. 14B).

In order to make the presence of bubbles in ink as small as possible, it is preferable to use the deaerated ink. Further, it is preferable to use a metallic tube, such as a stainless tube, which has a good gas barrier property as an ink supply tube 34*b*. Also, the ink bladder 34*a* and others should be formed without the provision of the atmospheric communication port where the gas in the atmosphere enters, while using the material having a good gas barrier property also for the ink bladder 34*a*.

As shown in FIG. 13, the ink container 34 from which the ink cover container 34*e* has been removed is inserted into the ink container inserting port of the recording apparatus main body. Also, the joint 34*c* of the ink container 34 is installed on the joint 107 of the recording apparatus main body.

For the recording apparatus main body, two guide shafts 31 are arranged in parallel in the directions indicated by arrows X and Y as shown in FIG. 13. Along these shafts 31, the recovery roller (pressurized recovery means) 30 is rotatively installed on the linearly movable supporting member 32 through the bearings. The supporting member 32 is allowed to engage with the ball screw 33 which is connected with the driving recovery motor 37 through the driving transmission unit (gears) 36. A rubber roller is most suitable for the use of the recovery roller 30, but a hard roller may also be applicable. The recovery roller 30 is positioned above the ink bladder 34*a* and fixed in the pinch roller fashion in which it is biased by a spring in the direction to squeeze the ink bladder 34*a* (downwardly in FIG. 13) or structured to keep a specific distance between the recovery roller 30 and the bottom face of the cover container 34*d*. In this way, it is arranged not to allow ink to leak externally from the portion where the ink bladder 34*a* is bonded under pressure when the recovery roller 30 squeezes the ink bladder 34*a*. Also, if it is structured in the pinch roller fashion, the spring pressure is set in a strength so that the recovery roller 30 does not escape when pressurized.

With the structure described above, the rotational directions and rotational speeds of the driving recovery motor 37 are adjusted to enable the recovery roller 30 to move in parallel in the X and Y directions. Thus, the ink bladder 34*a* is squeezed to supply ink in the interior of the ink bladder 34*a* to the recording head 1. Here, in accordance with the present embodiment, the recovery roller 30 moves linearly by means of the boll screw 33. However, it may be possible to use the timing belt, a rack gear, or some other driving transmission means for its linear movement. As the driving recovery motor 37, it is most suitable to adopt a pulse motor capable of rotating regularly and reversely, while changing the rotational speeds with a highly precise stoppage.

Now, the operation of the present embodiment will be described.

(The Ink Supply Operation)

At first, the ink container 34 from which the ink cover container 34*e* has been removed is inserted into the ink container insertion port of the recording apparatus main body as described earlier. Also, the joint 34*c* of the ink container 34 is installed on the joint 107 of the recording apparatus main body. Usually, when ink is supplied to the recording head 1, there is a limit to the height of the ink container 34 in holding the menisci of the nozzle unit of the recording head 1. The height difference is usually within approximately 100 mm between the recording head 1 and the ink container 34. In accordance with the present embodiment, however, the ink container 34 is arranged below the recording medium carrying means 5 in the position which is lower the face height of the recording head 1. Usually, the height of the recording medium carrying means 5 is at least 100 mm or more. Then, the height difference between the ink container 34 and the head 1 exceeds 100 mm so that it becomes impossible to hold the menisci of the nozzle unit of the recording head 1. Here, for the present embodiment, the recovery roller 30 is caused to shift in the direction X by driving the driving recovery motor 37 to press the ink bladder 34*a* to make its inner pressure positive. With the pressure thus exerted, ink can be supplied to the recording head 1 through the ink supply port 34*f* and the ink supply tube 34*b*.

Also, with the arrangement of the pressure sensor 35 on the way of the ink supply path of the head, the ink pressure can be detected by use of this pressure sensor 35. Then, the pressure data thus detected is fed back to the driving recovery motor 37 to adjust the pressure to match the specific pressure at which menisci can be held. Also, the shifting amount of the recovery roller 30 can be defined, which corresponds to one pulse portion of the driving recovery motor (pulse motor) 37 by means of the driving transmission unit (gears) 36. Therefore, the position of the recovery roller 30 is adjusted with respect to the ink bladder 34*a* to obtain the amount of pressure increase in the ink bladder corresponding to the one pulse portion of the driving recovery motor 37. Thus, if the pressure obtained by means of the pressure sensor 35 should be insufficient, the equivalent number of driving pulses is applied to the driving recovery motor 37, hence making it possible to work out easily whether or not a desired pressure is obtainable. In this manner, it is possible to hold the menisci of the recording head 1.

When printing is operated by the ink jet recording apparatus of the present embodiment, the inner pressure of the ink bladder 34*a* is gradually decreased, and the menisci of the nozzle unit of the recording head 1 can no longer be maintained. Therefore, as described earlier, the driving recovery motor 37 is actuated to shift the recovery motor 30 in the direction X. Then, the inner pressure of the ink bladder 34*a* is set at the pressure which is predetermined, hence making it possible to hold the menisci of the recording head appropriately.

(The Recovery Operation)

Figure 15B:
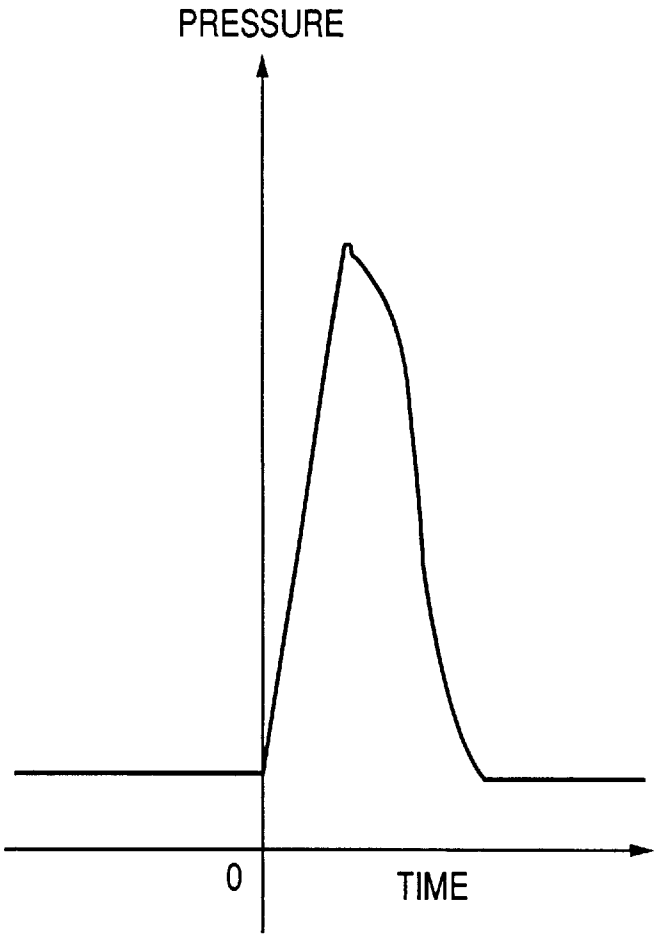
FIGS. 15A and 15B are graphs which illustrate the relationships between the pressure and time at the time of ink pressure recovery of the ink jet recording apparatus shown in FIG. 13.
Figure 15A:
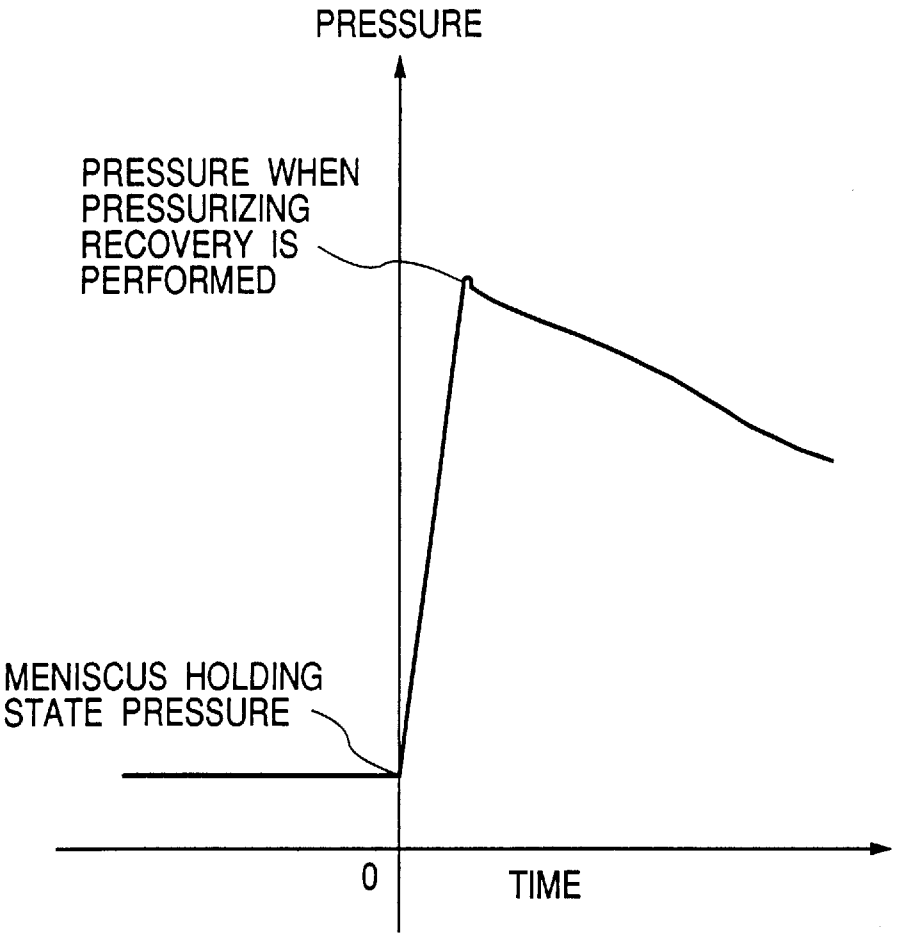

When the recording head 1 performs its continuous printing, the bubbles which are mainly created for discharging ink remain in ink. Then, with the development of such bubbles, the flow of ink in the nozzles is blocked eventually to cause disabled discharges. In order to prevent this occurrence, the recovery roller 30 is driven to shift in the direction X at a certain speed to squeeze the ink bladder 34 more. In this manner, the positive pressure is exerted on ink instantaneously to make it possible to exhaust by the positive pressure the bubbles accumulated in the nozzles together with ink from the nozzle outlets. However, if the recovery roller is kept there as it is after having moved in the direction X, t he pressure in the ink bladder is in the increased condition for a while as shown in FIG. 15A, which causes a large amount of ink in the interior to be exhausted from the nozzles. Thus, the amount of the exhausted ink which is wastefully used becomes greater. Now, therefore, after the pressurized recovery operation, the recovery roller 30 is driven to rotate reversely to return it in the direction Y from the direction X. Then, as shown in FIG. 15B, the pressure on ink returns to the state before the pressurized recovery immediately, hence making it possible to recover the recording head 1, while minimizing the amount of exhausted ink which is wastefully consumed.

As described above, in accordance with the present embodiment, the recovery roller 30 rolls on the ink bladder 34*a* when performing the supply and recovery of the recording head 1 so as to exert the positive pressure on ink in the ink bladder 34*a*. In this manner, the ink supply and recovery of the recording head 1 is executed. If it is set to automatically execute this pressurized recovery operation at the time of applying the electric power to the recording apparatus main body; per print of a specific number of sheets; or per temporal interval set by a timer (not shown) incorporated in the recording apparatus main body, there is no possibility of non-discharges in the printing operation.

With the structure thus arranged in accordance with the present embodiment, the height difference between the positions where the ink bladder and the recording head are arranged, respectively, is great. However, with the pressure exerted on the ink bladder to the extent equivalent to the process difference (water head difference) between them to supply ink sufficiently to the recording head even when the positional relationship between them makes it difficult to supply ink sufficiently to the recording head in accordance with the conventional art. In this way, it becomes possible to hold the menisci of the nozzle unit. As a result, even when the ink jet recording apparatus is provided with the recording medium carrying means 5 directly below the recording head 1, it becomes possible to ease the restriction imposed upon the arrangement of the ink container 34 with respect to the recording head 1, hence making the area occupied by the recording apparatus main body smaller.

Sixth Embodiment

Figure 16:
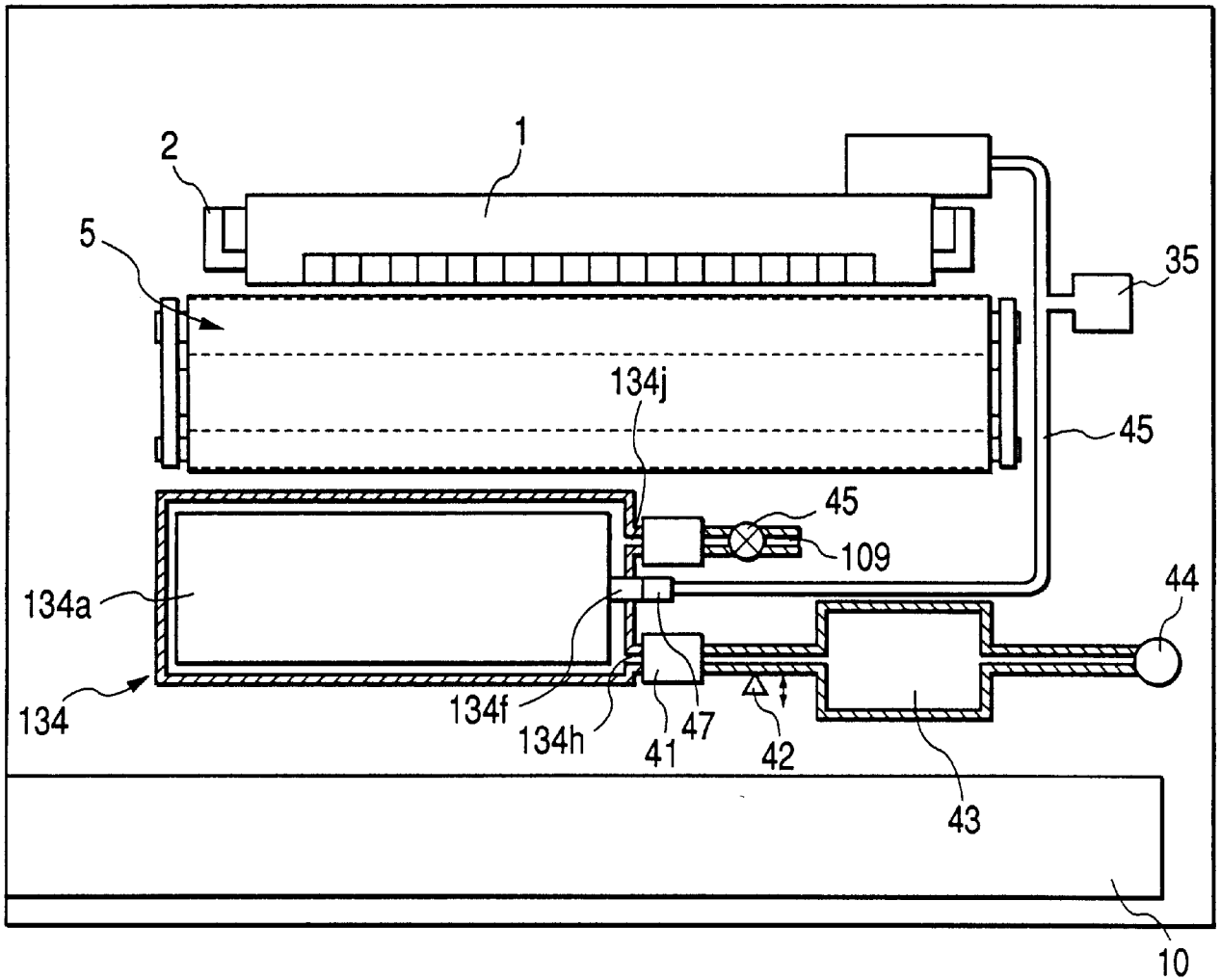
FIG. 16 is a view which illustrates the ink jet recording apparatus in accordance with a sixth embodiment of the present invention.

FIG. 16 is a cross-sectional view which shows the right side of the ink jet recording apparatus in accordance with a second embodiment of the present invention. Here, for the present embodiment, the same reference marks are applied to the same constituents as those appearing in the embodiments described earlier. The description thereof will be omitted.

Figure 5B:
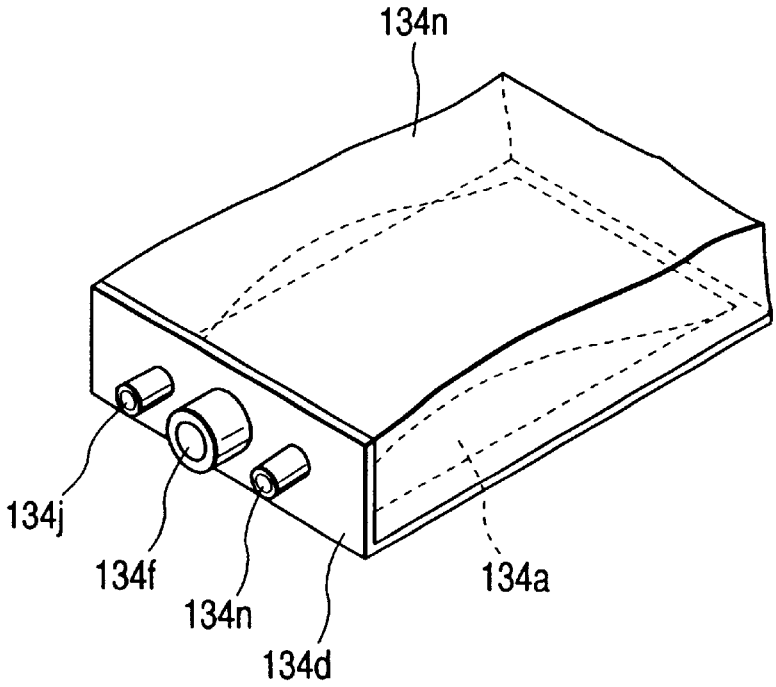

The ink container of the present embodiment is provided with the pressure port 134*h* and the exhaust port 134*j* as shown in FIG. 5B. When the ink container 134 is installed on the ink container insertion port of the recording apparatus main body, the ink supply port 134*f* is connected with the joint 47 to make it possible to supply ink in the ink bladder 134*a* to the recording head 1. The joint 47 has a valve structure (not shown) so that ink in the ink supply tube 45 is not allowed to leak when it is not connected with the ink supply port 134*f*, and that ink in the ink bladder 134*a* is supplied to the interior of the recording head 1 only when the joint is connected with it.

When the ink container 134 is mounted on the recording apparatus main body, the pressure port 134*h* of the ink container 134 is connected with the joint 41 of the recording apparatus main body. At the end of the joint 41, the buffer 43 is connected to retain the gas, such as the air, and then, at the end of the buffer 43, the pump (pressure recovery means) 44 is connected to send the air to the interior of the buffer 43. As the pump 44, the tube pump is most suitable, but a pump of any other type may be usable. Also, the stopper 42 is arranged between the pressure port 134*h* and the buffer 43. Then, the structure is arranged so that the stopper 42 is released when the interior of the buffer 43 is pressurized to a certain level in order to prevent the air from flowing into the ink container 134 when the air is retained in the buffer 43. The stopper 42 is structured to block the flow path of the rubber tube by pressing the roller on the tube by the application of spring force, and then, to switch the releasing or the like by turning on and off the solenoid (this structure is not shown). Here, in accordance with the present embodiment, it is most suitable to use a rubber tube formed by flexible material for the pipe that connects the pressure port 134*h* up to the pump 44, because the pump 44 is the tube pump, and also, the stopper 42 is arranged between the buffer 43 and the pressure port 134*h*.

When the ink container 134 is mounted on the recording apparatus main body, the exhaust port 134*j* of the ink container 134 is connected with the joint 40, and connected with the exhaust port 109 to exhaust the gas sent by the pump 44 to the interior of the ink container. The open and close valve 46 is arranged on the way to switch the flow path to be blocked or communicated.

On the intermediate portion of the ink supply tube 45, the pressure sensor 35 is arranged to detect the pressure of ink. When the pressure of ink is detected by the pressure sensor 35, it becomes possible to sense the ink remainders in the ink container (because if the ink remainders in the ink container become smaller, the pressure in the ink supply tube becomes lower). This detection may indicate whether or not the menisci are held in the nozzle unit of the recording head 1, and also, makes it possible to measure the pressure exerted on ink at the time of the recovery operation. Hence, an appropriate recovery operation can be executed. Also, if ink cannot be exhausted due to the clogging of the nozzles of the recording head 1 at the time of the pressurized recovery, the pressure sensor 35 detects any excessive pressure to suspend the pressurizing operation for the prevention of accidental occurrence, such as the breakage of the ink bladder 134*a*, among some others.

Now, each of the operations is summarized at the time of executing the ink supply operation and the recovery operation, respectively.

(The Ink Supply Operation)

With the ink container 134 installed on the insertion port of the recording apparatus main body, the pressure port 134*h* is connected with the buffer 43; the exhaust port 134*j* with the joint 40; and ink supply port 134*f* with the joint 47, respectively.

The valve 46 is in the state of being blocked, while the stopper 42 is in the state of being communicated. Then, the pump 44 send in the air into the ink container 134 to press the flexible ink bladder 134*a*, thus pushing out ink in the interior of the ink bladder to supply it to the recording head 1 through the ink supply tube 45. The ink container 134 is positioned below the recording medium carrying means 5 at a height (having a height difference of 100 mm or more with the recording head) which does not usually allow the holding of the menisci of the nozzle unit of the recording head 1. However, as described earlier, the air is sent into the ink container 134 to pressurize the interior of the ink container 134 to keep its pressure equivalent to the height difference between the face portion of the recording head 1 and the ink container 134, hence making it possible to hold the menisci of the nozzle unit of the recording head 1.

Also, in order to shorten the period of time until ink is supplied to the recording head 1, the air is supplied by the pump 44 into the ink container 134. In this process, the pressure is kept higher in the ink container 134 than the pressure equivalent to the height difference between the face portion of the recording head 1 and the ink container 134 at the initiation, and then, immediately before ink arrives at the recording head 1, the inner pressure of the ink container 134 is reduced to make it equivalent to the height difference between the face portion of the recording head 1 and the ink container 134. In this manner, the operating time can be shortened.

Here, for the adjustment of the inner pressure of the ink container 134, there is a method for making the adjustment, while detecting the inner pressure of the ink container 134 by use of the gas pressure sensor (not shown) installed in the buffer 43 or a method for making the adjustment of the inner pressure of the ink container 134 by controlling the rotational number of the tube pump 44 in accordance with the relationship obtained in advance between the actuation amount (rotational numbers) of the tube pump 44 and the condition of the inner pressure of the ink container 134, among some other methods.

After the completion of the ink supply, the valve 46 and the stopper 42 are put in the blocked state to keep the inner pressure of the ink container 134 at a constant level.

(The Recovery Operation)

At first, the valve 46 and the stopper 42 are put in the state of being blocked. Then, the pump 44 is actuated to fill the interior of the buffer 43 with the air for pressurizing use. Then, as described earlier, the pressure in the buffer 43 is detected by the gas pressure sensor (not shown) installed in the buffer 43 at that time or it is known by obtaining the pressure corresponding to the rotational numbers of the pump 44.

Then, the stopper 42 is communicated to carry the air in the buffer 43 to the ink container 134 at once, thus squeezing the ink bladder 134*a* by the application of the air pressure. When the ink bladder 134*a* is squeezed, ink flows into the recording head 1 at once to cause ink and the bubbles or the like to flow out from the nozzle unit of the recording head 1, hence executing the pressurized recovery operation of the recording head 1.

After the stopper 42 is communicated, the valve 46 is released immediately, hence making it possible to minimize the amount of unwanted ink exhausted from the nozzles at the time of executing the pressurized recovery operation.

With the structure of the present embodiment as described above, it becomes possible to hold the menisci of ink by supplying ink to the recording head sufficiently irrespective of the height difference between the arrangement positions of the ink bladder and the recording head as in the fifth embodiment described earlier. Therefore, while the restriction imposed upon the arrangement of the ink container 134 is eased, it is possible to make the area smaller, which is occupied by the recording apparatus main body.

Here, in accordance with the above description, the air is used as the medium to pressurize the ink bladder 134*a*, but it may be possible to use liquid instead of such air. In this case, now that the pressurizing medium is liquid, it becomes possible to obtain a greater pressure to the extent that it has a lower compressibility than gas, hence enhancing the recovery performance accordingly.

Seventh Embodiment

Figure 17:
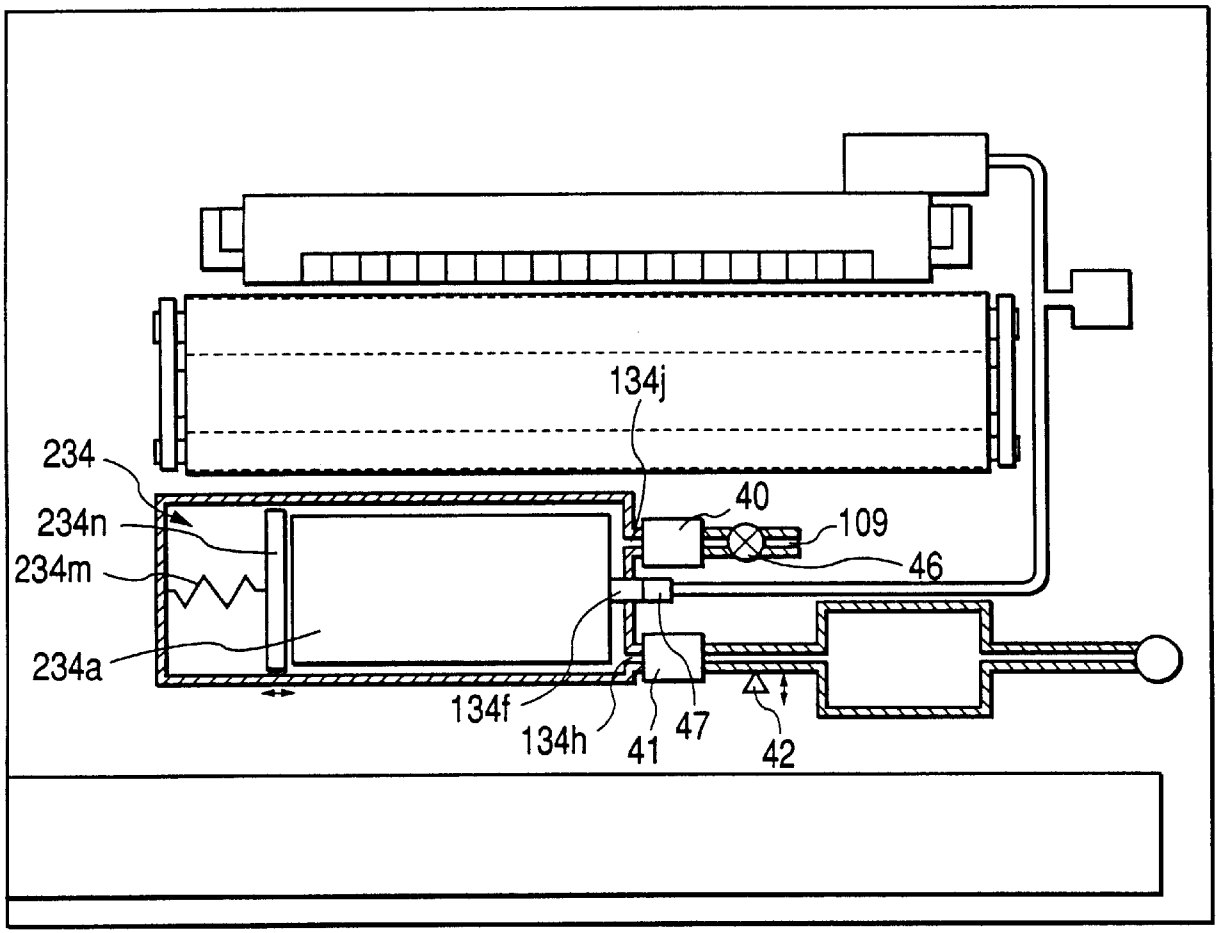
FIG. 17 is a view which illustrates the ink jet recording apparatus in accordance with a seventh embodiment of the present invention.

FIG. 17 is a view which shows the right side of the ink jet recording apparatus in accordance with a seventh embodiment of the present invention.

For the present invention, the pressure spring 234*m* is arranged in the ink container 234 to press the ink bladder 234*a*. The pressure spring (pressurized recovery means) 234*m* presses the ink bladder 234*a* at all times through the ink bladder pressure plate 234*n*. The pressure of the pressure spring 234*m* is balanced with the pressure that may be exerted by the height difference between the ink container 234 and the face portion of the recording head 1, and it is set at the pressure equivalent to the height difference between the ink container 234 and the face portion of the recording head, thus holding the menisci of the nozzle unit of the recording head 1 (so as not to allow ink from flowing reversely).

As described above, the spring force is always given to the ink bladder 234*a* in the ink container to ease the restriction imposed upon the arrangement of the ink container 234 that contains the ink bladder 234*a* with respect to the recording head 1, and also, to make the area smaller, which is occupied by the recording apparatus main body.

As described above, in accordance with the present invention, the flexible ink bladder is pressed in the ink supply path between the ink bladder and the recording head to make it possible to the ink supply to the recording head and the recovery operation of the recording head. Particularly, with the structure in which the flexible sub-ink bladder on the way between the recording head and the ink bladder, it becomes possible to implement the curtailment of the space of the recording apparatus.

In accordance with the ink jet recording apparatus described above, there is no possibility that the deaerated ink that is adopted for use is not exposed to the air outside in the ink supply path from the ink bladder to the recording head so that the degree of deaeration of ink is rarely caused to be lowered. In addition, with the increasing or decreasing operation of the pressure by use of pressure adjustment means, it becomes possible to implement the ink replenishment from the main container to the sub-container, and then, from the sub-container to the recording head, and the recovery operation as well without the installation of the pump or the like in the ink supply path. At the same time, as to the ink replenishment from the sub-container to the recording head, in particular, the pressurizing operation is adopted to replenish ink. As a result, it becomes possible to use the ink in the container effectively, at the same time, implementing the stabilized output of images in higher quality.

For the ink jet recording apparatus described above, it is unnecessary to consider the water head difference and the balance of the negative pressures between the ink container and the recording head. Therefore, even when the deaerated ink or the like is used, it is possible to adopt effectively the ink container having greater changes of pressure along with the led-out of ink, although it is flexible or having a higher negative pressure generated at the ink supply port. With resin as the material of the ink bladder, the ink container can cope with the environmental problems, and at the same time, it utilizes the effect of the aforesaid recording apparatus to make the ink container firmer (or having the thick ink bladder in it) without a smaller amount of deformation following the led-out of ink. In this manner, it becomes possible to satisfy the conditions of the gas permeability and the resistance to shocks.

Also, in accordance with the present invention, the ink container can be structured to form the ink bladder with resin materials to make it easier to perform the incineration for disposition or recycling, at the same time, making the negative pressure higher in advance in the initial stage with the higher robustness of the material itself with which to form the bladder. As a result, there is almost no fear that the bladder is broken due to the shocks or the repeated and abrupt environmental changes during the delivery or the occurrence of ink leakage due to the damage that may be given to the sealing at the ink supply port due to the shocks during the delivery.

In this respect, the pressure equivalent to the height difference (water head difference) between the ink bladder and the recording head is given to the ink bladder of the ink jet recording apparatus of the present invention, it becomes possible to supply sufficiently to hold the menisci of ink, hence reducing the height restriction imposed upon the ink bladder with respect to the recording head to increase the freedom of designing, and implement the curtailment of the space occupied by the recording apparatus as well.

Then, with the structure arranged to house the ink bladder in the recording medium carrying means positioned below the recording head, it is made possible to position the ink bladder at a height that enables the menisci to be held for ink in the recording head, and then, to attempt the curtailment of space to be occupied by the apparatus main body.

What is claimed is:

1. An ink jet recording apparatus comprising:

an ink jet recording head for discharging ink onto a recording medium for the formation of images;

an ink container provided with an ink bladder to store ink for said recording head;

an ink supply path for supplying ink from said ink container to said recording head;

a sub-container arranged on said ink supply path to retain ink from said ink container provisionally and to supply said ink to said recording head, wherein said sub-container includes:

an ink inlet port for receiving ink from said ink container, and an ink outlet port for leading ink out to said recording head;

a sub-ink bladder for forming a closed space for ink with the exception of said ink inlet port and ink outlet port;

a case for covering said sub-ink bladder, said case having a communicating portion with the outside, said case for protecting said bladder in a closed space in said case;

a first open and close valve provided for said ink inlet port;

a second open and close valve provided for said ink outlet port; and a pressure adjustment unit communicated with said communicating portion to adjustably increase or decrease pressure in the space between said sub-ink bladder and said case.

2. An ink jet recording apparatus according to claim 1, wherein said case is provided with an atmospheric communication portion communicating the interior of said case with ambience, and an atmospheric communication open and close valve provided for said atmospheric communication portion.

3. An ink jet recording apparatus according to claim 2, wherein said atmospheric communication open and close valve and said second open and close valve are closed, and said first open and close valve is opened to reduce the pressure by said pressure adjustment means in the space between said sub-ink bladder and said case and to replenish ink from said ink container to said sub-ink bladder.

4. An ink jet recording apparatus according to claim 3, wherein before said first open and close valve is opened, a pressure reducing operation is performed by said pressure adjustment unit.

5. An ink jet recording apparatus according to claim 3, wherein said first open and close valve is closed after said ink replenishing operation, and said atmospheric communication open and close valve and said second open and close valve are opened after the operation of said pressure adjustment unit is suspended.

6. An ink jet recording apparatus according to claim 2, wherein said atmospheric communication open and close valve and said first open and close valve are closed, and said second open and close valve is closed to replenish ink from said sub-ink bladder to said recording head by pressurizing the space between said sub-ink bladder and said case by use of said pressure adjustment unit.

7. An ink jet recording apparatus according to claim 1, wherein said sub-container is provided with a remainder detecting unit for detecting ink remainder in said sub-ink bladder.

8. An ink jet recording apparatus according to claim 1, wherein said ink container is positioned above said sub-ink bladder whereby ink is applied to said sub-ink bladder by a difference in water head.

9. An ink jet recording apparatus according to claim 1, wherein said ink is deaerated ink.

10. An ink container mountable on an ink jet recording apparatus according to claim 1, said ink container comprising:

an ink bladder containing ink, and an ink supply port to lead ink out of said ink bladder to the outside, said ink bladder being formed by flexible resin material.

11. An ink container according to claim 10, wherein the resin material for forming said ink bladder has an oxygen permeability of 1.0 $cc/m^2 \cdot atm \cdot 24$ hrs or less.

12. An ink container according to claim 10, wherein the resin material for forming said ink bladder has a nitrogen permeability of 0.3 $cc/m^2 \cdot atm \cdot 24$ hrs or less.

13. An ink container according to claim 10, wherein ink contained in said ink bladder has an amount of dissolved oxygen of 5.43 mg/l or less.

14. An ink container according to claim 10, wherein ink contained in said ink bladder has an amount of dissolved nitrogen of 10 mg/l or less.

15. An ink container according to claim 10, wherein the inner pressure at the ink supply port of said ink bladder is −200 mmAq. or less with respect to the air outside before installation on the ink jet recording apparatus.

16. An ink container according to claim 10, wherein there is an absolute value of difference between the inner pressure at the ink supply port of said ink bladder with respect to the air outside before installed on the ink jet recording apparatus, and the inner pressure at the ink supply port of said ink bladder after ink is used, and wherein the absolute value of the difference is 300 mmAq. or more.

17. An ink container according to claim 10, wherein said ink is deaerated ink.

18. An ink container provided with an ink bladder containing ink, and an ink supply port to lead ink out of said ink bladder to the outside, wherein said ink bladder is formed by flexible resin material, and wherein a difference of negative pressure between before commencement of use and after termination of use at said ink supply port is no less than 300 mmAq.

19. An ink container according to claim 18, wherein the resin material for forming said ink bladder has an oxygen permeability of −1.0 $cc/m^2 \cdot atm \cdot 24$ hrs or less.

20. An ink container according to claim 18, wherein the resin material for forming said ink bladder has a nitrogen permeability of 0.3 $cc/m^2 \cdot atm \cdot 24$ hrs or less.

* * * * *

UNITED STATES PATENT AND TRADEMARK OFFICE

CERTIFICATE OF CORRECTION

PATENT NO. : 6,315,402 B1
DATED : November 13, 2001
INVENTOR(S) : Junya Kawase

It is certified that error appears in the above-identified patent and that said Letters Patent is hereby corrected as shown below:

Title page,
Item [56] References Cited, U.S. PATENT DOCUMENTS, insert
-- 6,059,405 5/2000 Mochizuki et al. 347/92
5,367,328 11/1994 Erickson 342/7 --.

Column 1,
Line 29, "speed higher still." should read -- still higher speed. --.

Column 2,
Line 59, "form" should read -- from --.

Column 3,
Line 50, "beings" should read -- begins --.

Column 5,
Line 9, "a" should read -- to a --.

Column 7,
Line 28, "form" should read -- from --.

Column 8,
Line 17, "subs-container" should read -- sub-container --; and
Line 35, "-the" should read -- the --.

Column 14,
Line 53, "when" should read -- When --.

Column 18,
Line 34, "lower" should read -- lower than --.

UNITED STATES PATENT AND TRADEMARK OFFICE

CERTIFICATE OF CORRECTION

PATENT NO. : 6,315,402 B1
DATED : November 13, 2001
INVENTOR(S) : Junya Kawase

It is certified that error appears in the above-identified patent and that said Letters Patent is hereby corrected as shown below:

Column 19,
Line 22, "t he" should read -- the --.

Signed and Sealed this

Seventh Day of May, 2002

*Attest:*

*Attesting Officer*

JAMES E. ROGAN
*Director of the United States Patent and Trademark Office*